US008064783B2

(12) United States Patent
Usui et al.

(10) Patent No.: US 8,064,783 B2
(45) Date of Patent: Nov. 22, 2011

(54) IMAGE FORMING APPARATUS

(75) Inventors: Tomoya Usui, Yamatokoriyama (JP); Takahiko Kimura, Ikoma (JP); Shuichi Akedo, Sakai (JP)

(73) Assignee: Sharp Kabushiki Kaisha, Osaka (JP)

( * ) Notice: Subject to any disclaimer, the term of this patent is extended or adjusted under 35 U.S.C. 154(b) by 564 days.

(21) Appl. No.: 12/202,585

(22) Filed: Sep. 2, 2008

(65) Prior Publication Data

US 2009/0080909 A1 Mar. 26, 2009

(30) Foreign Application Priority Data

Sep. 21, 2007 (JP) ..... 2007-246019

(51) Int. Cl.
*G03G 15/00* (2006.01)

(52) U.S. Cl. ..... 399/13; 399/83

(58) Field of Classification Search ..... 399/12, 399/13, 83

See application file for complete search history.

(56) References Cited

U.S. PATENT DOCUMENTS 4,961,088 A 10/1990 Gilliland et al.
5,636,032 A 6/1997 Springett
2003/0228171 A1 * 12/2003 Miyabe et al. ..... 399/111

FOREIGN PATENT DOCUMENTS

JP 2004-069943 3/2004

OTHER PUBLICATIONS

Machine translation of JP 2004-069943.*

* cited by examiner

*Primary Examiner* — David Gray
*Assistant Examiner* — Barnabas Fekete
(74) *Attorney, Agent, or Firm* — Nixon & Vanderhye P.C.

(57) ABSTRACT

An image forming apparatus includes a toner cartridge supporting member which is movable between an insertion position and a draw-out position. An information storage device is provided on a toner cartridge that is mounted on the toner cartridge supporting member. A connector that is configured to engage the information storage device is provided on the image forming apparatus. The connector is movable in a moving direction of the toner cartridge supporting member. When a toner cartridge on the toner cartridge supporting member moves toward the draw-out position, the connector moves with and remains engaged with the information storage device for part of the movement so that information can be read from or written to the information storage device before the toner cartridge arrives at the draw-out position.

14 Claims, 20 Drawing Sheets

IMAGE FORMING APPARATUS

This Nonprovisional application claims priority under 35 U.S.C. §119(a) on Patent Application No. 246019/2007 filed in Japan on Sep. 21, 2007, the entire contents of which are hereby incorporated by reference.

FIELD OF THE TECHNOLOGY

The technology is related to an image forming apparatus for use in an electrostatic copying machine, a laser printer, a facsimile, or the like.

BACKGROUND OF THE TECHNOLOGY

An image forming apparatus (such as a copying machine and a printer) which forms an image by means of an electrophotographic printing method has the following feature: when toner, which is contained in a developing tank and which makes visible an electrostatic latent image formed on a surface of a photoreceptor drum, is consumed and reduced in its amount, toner is supplied from a toner cartridge to the developing tank. For example, when two-component toner including toner and carrier is used, toner contained in a toner cartridge is supplied to a developing tank so that a toner density in toner in the developing tank is not less than a predetermined value. The toner cartridge is detachably and attachably arranged to a predetermined position in the image forming apparatus. When a toner cartridge which is attached to the image forming apparatus runs out of toner, the toner cartridge is exchanged with another.

The electrophotographic printing method in the image forming apparatus encompasses various kinds of methods such as a positive charging method and a reverse charging method. There are many types of toner having different characteristics for respective methods. Also, the type of toner is predetermined for each model of image forming apparatus.

An exchange of a toner cartridge is mostly carried out by a user. When a plurality of image forming apparatuses of different models are closely provided one to another, there is a possibility that a toner cartridge prepared for one model of the image forming apparatuses is attached to another model of the image forming apparatuses by mistake. Especially in image forming apparatuses of the same manufacturer, toner cartridges having the same shape often contain toner of different characteristics. In cases where a plurality of image forming apparatuses of different types closely provided one to another are thus of the same manufacturer, a user easily makes a mistake and attaches a wrong toner cartridge in an exchange.

In light of this, there has been known a conventional image forming apparatus in which, in a toner cartridge, an information storage section for storing inherent information such as a toner characteristic is provided. With this arrangement, it is possible (i) to judge and display whether or not an attached toner cartridge is suitable based on information which is read out from an information storage section by an information processing device provided on the image forming apparatus side (Japanese Unexamined Patent Application Publication, Tokukaihei, No. 2-296259 (published on Dec. 6, 1990)); (ii) to inform remaining amount of toner to a user so that a toner cartridge does not run out of toner suddenly (Japanese Unexamined Patent Application Publication, Tokukaihei, No. 9-134098 (published on May 20, 1997)).

The conventional image forming apparatus, however, has the following problem: when a toner cartridge is suddenly detached from the image forming apparatus during a communication between an information storage section and an information processing device, such a communication is interrupted, thereby causing a communication error. This will cause the following problem. For example, in a case where a toner end of a toner cartridge is determined in accordance with the number of rotations of a motor, the main body of an image forming apparatus transmits the number of rotations of the motor to an IC chip. Therefore, if the communication between the information storage section and the information processing device is interrupted, then the IC chip will have wrong information about the number of rotations of the motor. This will cause a timing of a toner end to be inaccurate. As a result, the following problems will occur: (i) even when it is judged to be a toner end, a large amount of toner still remains in a cartridge; (ii) even when toner in a cartridge runs out, it is not judged to be a toner end.

SUMMARY OF THE TECHNOLOGY

An object of the technology is to provide an image forming apparatus which does not cause any communication error in a communication between an information storage section and an information processing device, even when a toner cartridge is suddenly detached from the image forming apparatus.

In order to attain the object, an image forming apparatus of the technology includes: a toner cartridge detachably and attachably provided in a predetermined position in the image forming apparatus; a toner cartridge supporting member provided to support the toner cartridge, and to be installed so that the toner cartridge supporting member is movable between (i) an insertion position indicating that the toner cartridge is in the predetermined position and (ii) a draw-out position indicating that the toner cartridge is drawn out from the predetermined position; a detection device which detects a movement of the toner cartridge supporting member in a direction pointing from the insertion position toward the draw-out position; an information storage device, provided in the toner cartridge, in which inherent information of the toner cartridge is stored; a connector which is provided so as to be detached from or fitted to the information storage device and is provided on a connector attaching member in the image forming apparatus so as to be movable in a moving direction of the toner cartridge supporting member; and an information processing device which is capable of communicating with the information storage device via the connector, carries out writing and readout of the inherent information with respect to the information storage device, and carries out a communication stop process for causing a communication between the information processing device and the information storage device to be stopped when the detection device detects the movement of the toner cartridge supporting member.

With this arrangement, the connector is provided so that the connector is movable in the moving direction of the toner cartridge supporting member. That is, when the detection device detects the movement of the toner cartridge supporting member in a direction pointing from the insertion position toward the draw-out position, the connector is fitted into the information storage device. Thereby, the information storage device on the toner cartridge side can maintain the communication with the information processing device on the image forming apparatus side. This allows the information processing device to carry out a predetermined communication stop process before the communication is stopped between the information processing device and the information storage device. This makes it possible to ensure time necessary for the information processing device to carry out the communication stop process for stopping the communication between the information processing device and the information storage device before the communication is stopped between the two after the detection device detects that the toner cartridge supporting member moves in the direction pointing from the insertion position toward the draw-out position.

This prevents a communication error from occurring in the communication between the information processing device and the information storage device even when the toner cartridge supporting member is suddenly drawn out from the insertion position in the image forming apparatus.

BRIEF DESCRIPTION OF THE DRAWINGS

FIG. 15 (*b*) is an explanatory diagram illustrating memory contents of a memory in the information storage device illustrated in FIG. 14.

FIG. 17 (*b*) is a flow chart illustrating how the information storage device operates when the information storage device receives a read-out request or a writing request from the information processing device in the arrangement illustrated in FIG. 14.

DESCRIPTION OF THE EMBODIMENTS

The following describes one embodiment with reference to the drawings.

Figure 8:
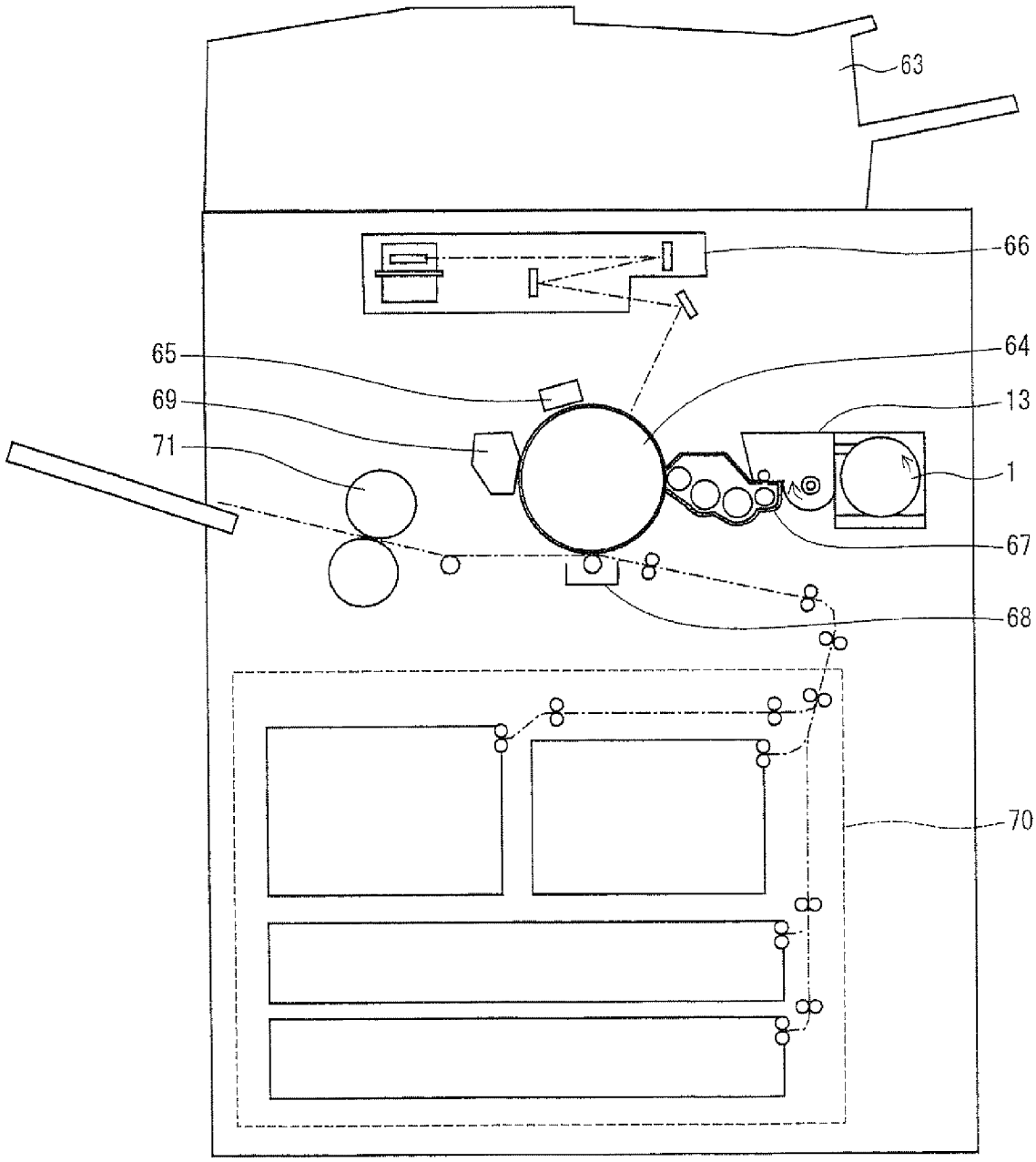
FIG. 8 is a longitudinal cross-section view schematically illustrating the image forming apparatus of one embodiment.

FIG. 8 is a longitudinal cross-section view schematically illustrating an image forming apparatus of one embodiment. As shown in FIG. 8, the image forming apparatus of the embodiment includes a scanner 63, a photoreceptor drum 64 (i.e., an image forming section), a charging device 65, an exposure device 66, a developing device 67, a transfer device 68, a cleaning device 69, a sheet feeding unit 70, and a fixing unit 71.

The scanner 63 scans an image from an original document. The photoreceptor drum 64 is rotatably provided and holds an electrostatic latent image on its peripheral surface so as to form the image scanned from the original document by the scanner 63. The charging device 65 charges the photoreceptor drum 64. The exposure device 66 includes a laser beam scanner for forming, on the photoreceptor drum 64, an electrostatic latent image corresponding to the image of the original document. The developing device 67 develops the electrostatic latent image so as to form a toner image.

The transfer device 68 transfers the toner image on the photoreceptor drum 64 onto a sheet. The cleaning device 69 removes remaining developer on the photoreceptor drum 64. The sheet feeding unit 70 feeds a sheet to the photoreceptor drum 64. The toner image thus transferred is fixed on the sheet by the fixing unit 71.

In the present embodiment, a toner cartridge 1 and a toner hopper 13 are horizontally juxtaposed to each other. Toner contained in the toner cartridge 1 is supplied to the toner hopper 13, is supplied to the developing device 67, and is ultimately fixed on a sheet so as to form an image.

Figure 1:
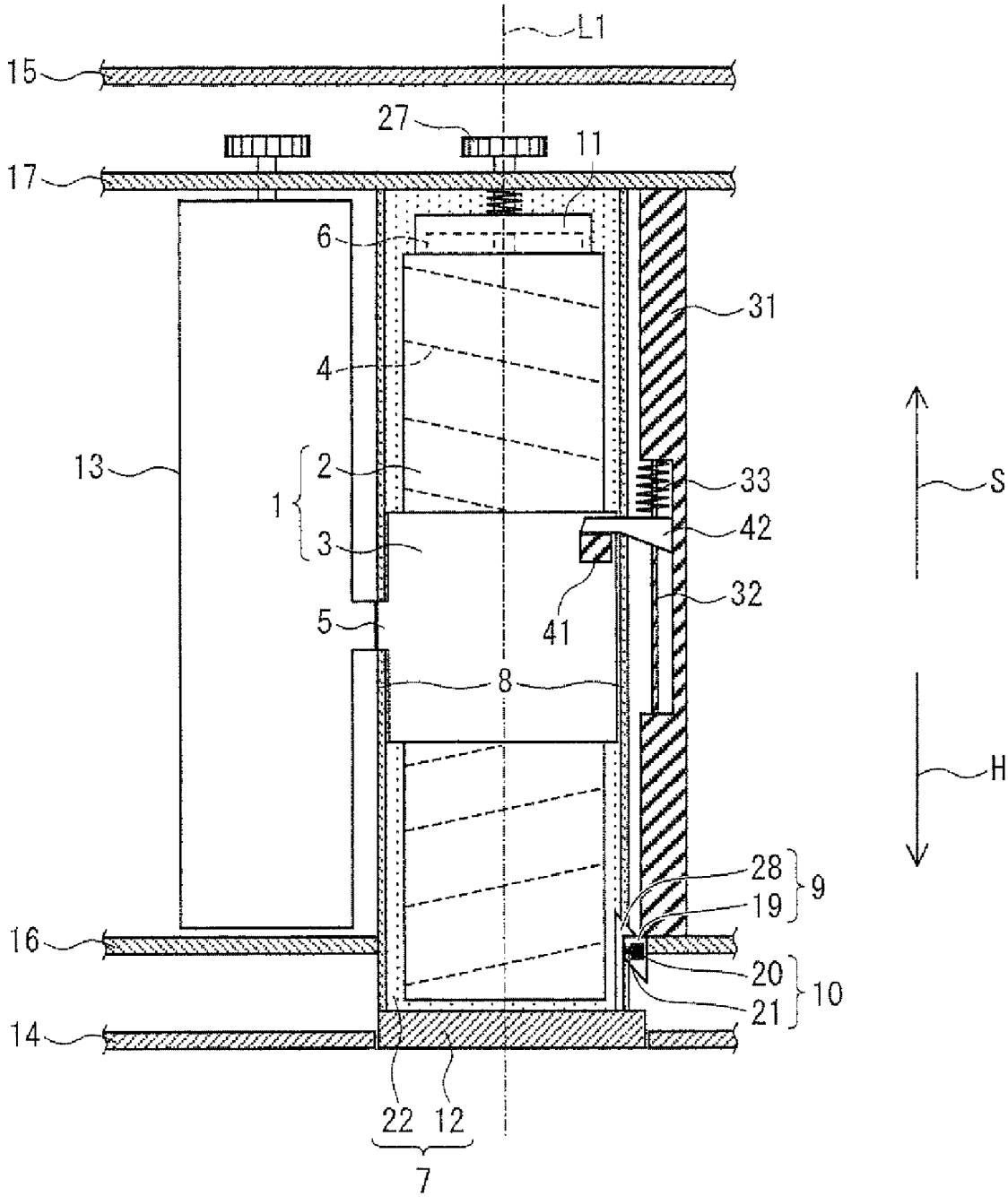
FIG. 1 illustrates an arrangement of the main parts in an image forming apparatus, and is a plan view illustrating: a toner cartridge supported by a toner cartridge supporting member; and the surroundings of the toner cartridge.
Figure 2:
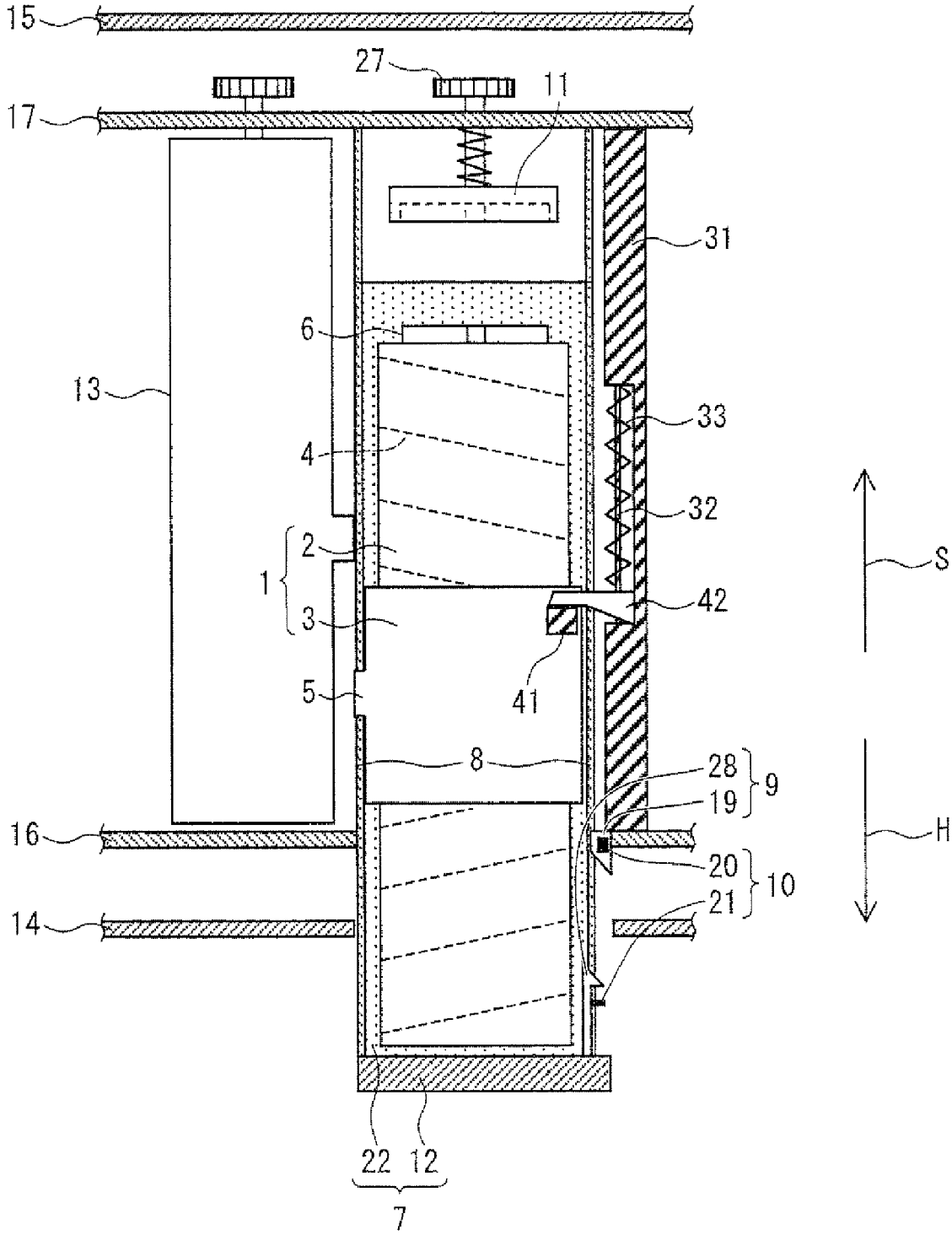
FIG. 2 is a plan view illustrating a state where the toner cartridge supporting member is in the process of being drawn out from the image forming apparatus illustrated in FIG. 1 in a toner cartridge supporting member draw-out direction.
Figure 3:
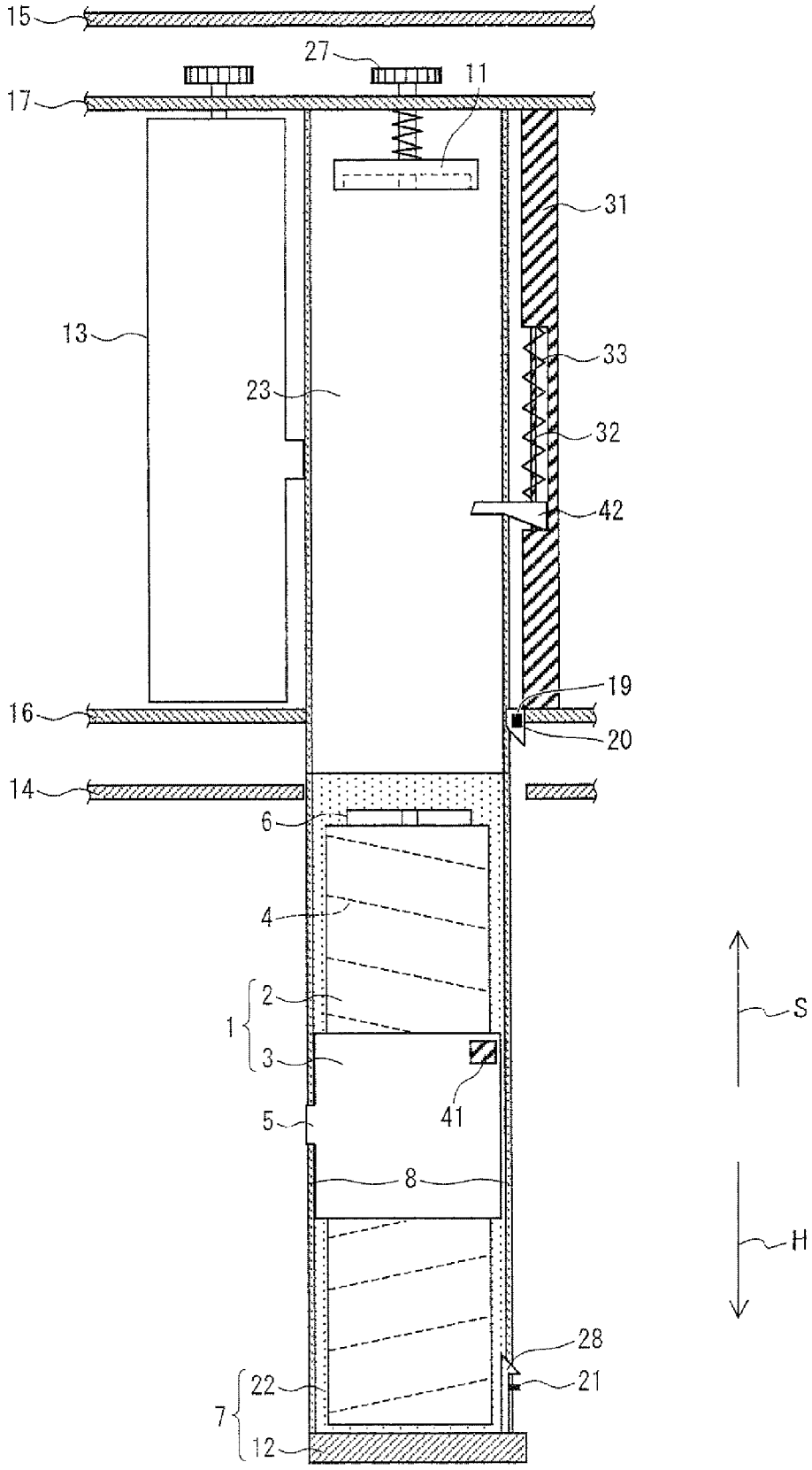
FIG. 3 is a plan view illustrating a state where the toner cartridge supporting member has been drawn out completely from the image forming apparatus illustrated in FIG. 1 in the toner cartridge supporting member draw-out direction.
Figure 4:
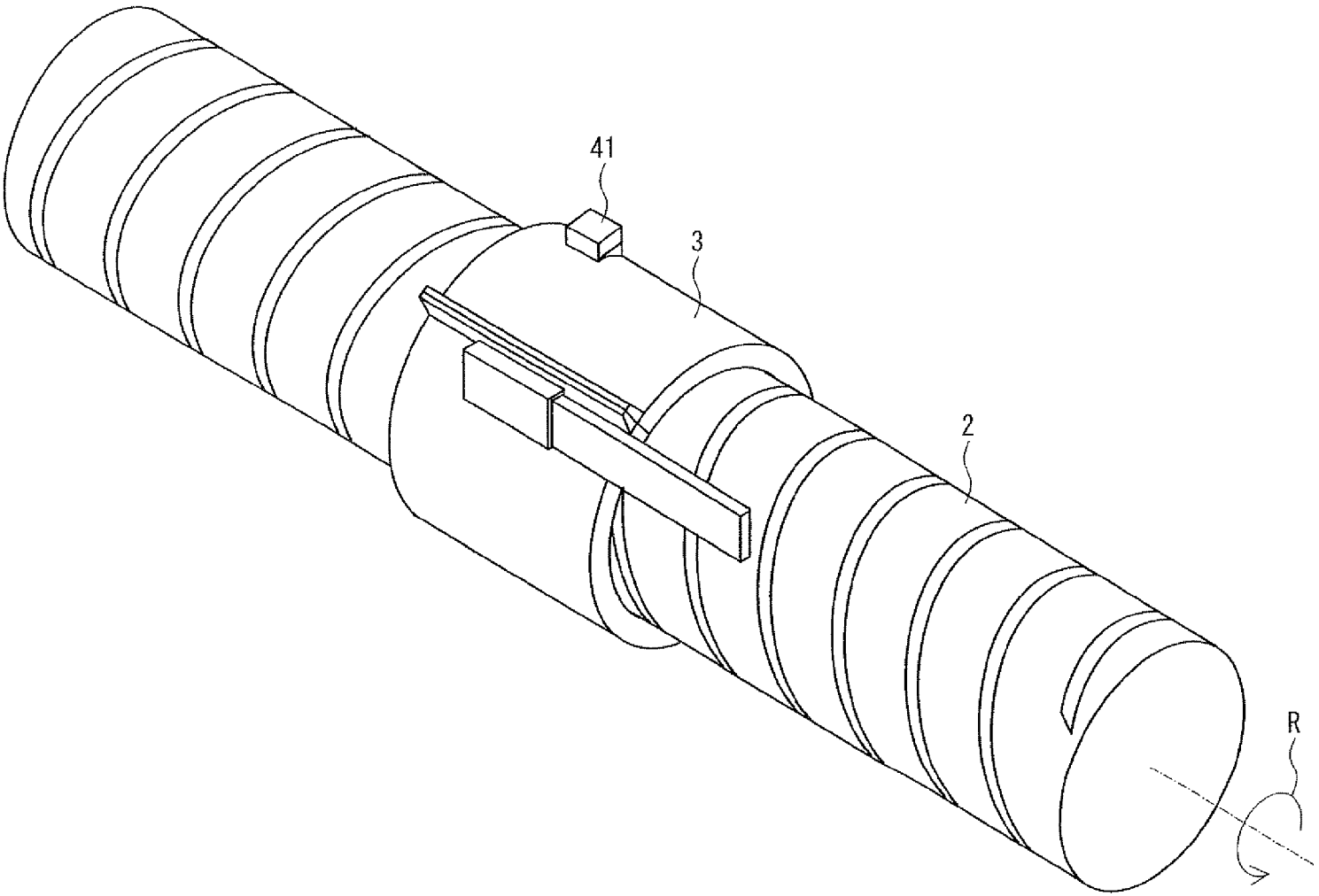
FIG. 4 is a perspective view of the toner cartridge illustrated in FIG. 1.
Figure 5:
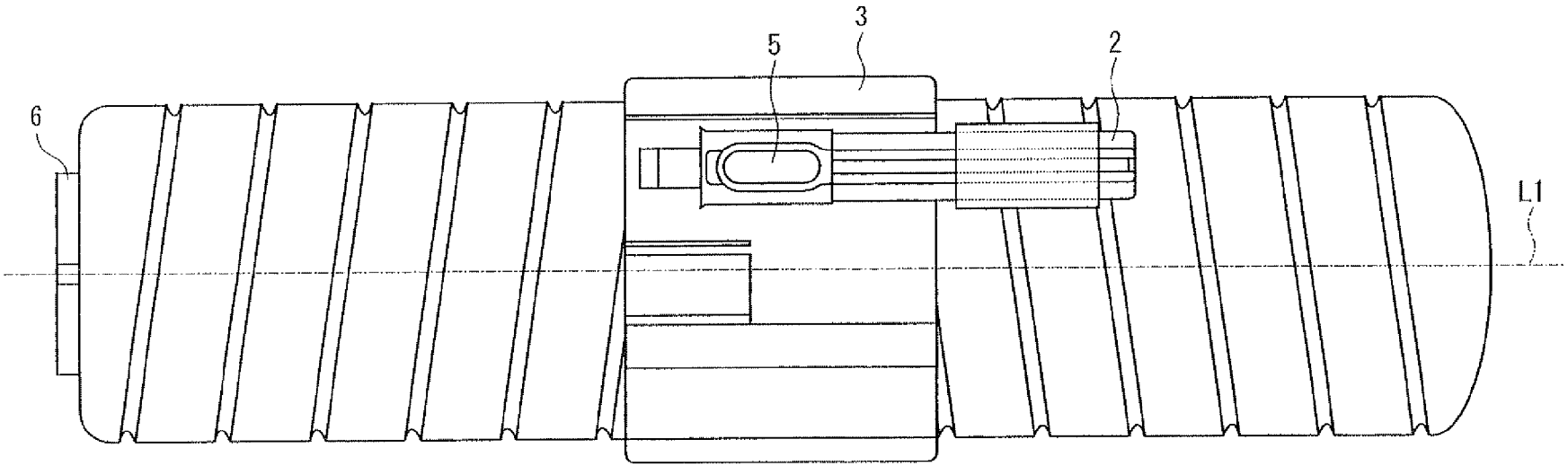
FIG. 5 is an elevation view of the toner cartridge illustrated in FIG. 1.

FIG. 1 illustrates an arrangement of the main parts in an image forming apparatus of one embodiment, and is a plan view illustrating: a toner cartridge 1 supported by a toner cartridge supporting member 7; and the surroundings of the toner cartridge 1. FIG. 2 is a plan view illustrating a state where a toner cartridge supporting member 7 is in the process of being drawn out from the image forming apparatus illustrated in FIG. 1 in a toner cartridge supporting member draw-out direction H (hereinafter, merely referred to as a draw-out direction H). FIG. 3 is a plan view illustrating a state where the toner cartridge supporting member 7 has been drawn out completely from the image forming apparatus in the draw-out direction H. FIG. 4 is a perspective view and FIG. 5 is an elevation view, both figures illustrating a toner cartridge 1 having a spiral toner guide projection for conveying toner which is contained inside the toner cartridge 1.

As shown in FIG. 1, the outer periphery of the image processing apparatus is covered with exteriors. The exteriors include a front exterior 14 and a rear exterior 15 which face each other. The front exterior 14 is normally positioned in front of a user when the user uses the image forming apparatus. The rear exterior 15 is positioned on the backside of the image forming apparatus when the user sees the rear exterior 15 from the front exterior 14 side.

The toner cartridge 1 includes (i) a toner container 2, which has a bottom and a cylindrical shape and contains toner to be supplied, and (ii) a supporting member 3, which supports the toner container 2 so that the toner container 2 is rotatable around an axis line L1.

The toner container 2 includes a container-side connecting section 6 (illustrated in a dotted line in FIG. 1), a discharge opening 5, and a toner guide projection 4. The container-side connecting section 6 receives rotational drive force transmitted from the main body of the image forming apparatus via a drive force transmission mechanism 11. The discharge opening 5 is provided, in a place of the toner cartridge 1 where the supporting member 3 is attached, for supplying toner contained in the toner cartridge 1 to the toner hopper 13. The toner guide projection 4 is provided in the inner periphery of the cylinder of the toner cartridge 1 so as to have a spiral shape which is in accordance with a rotation direction in which the toner cartridge 1 rotates. This allows the toner cartridge 1 to rotate around the axis line L1, thereby conveying toner toward the discharge opening 5 while the toner is broken into flakes. The supporting member 3 supports the toner container 2 so as to entirely enwrap a part of the outer periphery of the toner container 2 in the vicinity of the center of the toner container 2 in the axis direction of the toner cartridge 1.

The toner cartridge 1 is attached to the toner cartridge supporting member 7 in the image forming device. When the toner cartridge 1 is attached to the toner cartridge supporting member 7, the toner cartridge 1 is fixed at a predetermined position in the toner cartridge supporting member 7.

The toner cartridge supporting member 7 includes a bottom wall section 22 and a front wall section 12. The bottom wall section 22 extends in a back and forth direction (front-rear direction) of the image forming apparatus, and serves as a base part on which the toner cartridge 1 is placed. In the toner cartridge supporting member 7, the front wall section 12 is provided on the front side of the image forming apparatus, and serves as a part of the front exterior 14.

It is in a storage space 23 (see FIG. 3) for storing the toner cartridge 1 that the toner cartridge supporting member 7 in the image forming apparatus is placed. A housing back section 17 is provided at a back end of the storage space 23. A front end of the storage space 23 reaches the front exterior 14, via a through-hole of a housing front section (fixing member) 16. The housing front section 16 and the housing back section 17 are provided between the front exterior 14 and the rear exterior 15.

The toner cartridge supporting member 7 is provided so as to be movable back and forth (i.e., move in a front-back direction) between (i) a state where the toner cartridge supporting member 7 is stored in the storage space 23 and (ii) a state where the toner cartridge supporting member 7 is drawn out forward (in a front direction) from the storage space 23.

The bottom wall section 22 of the toner cartridge supporting member 7 includes two guide members 8 so that the toner cartridge supporting member 7 is movable as descried above. That is, the toner cartridge supporting member 7 is supported by the two guide members 8 which are extendable, in parallel with the axis line L1, over the housing front section 16 from the housing back section 17. This allows the toner cartridge supporting member 7 and the toner cartridge 1 to be drawn out, in the draw-out direction H in the extending direction of the guide members 8, from the inside of the image forming apparatus to the outside of the front exterior 14.

Figure 6:
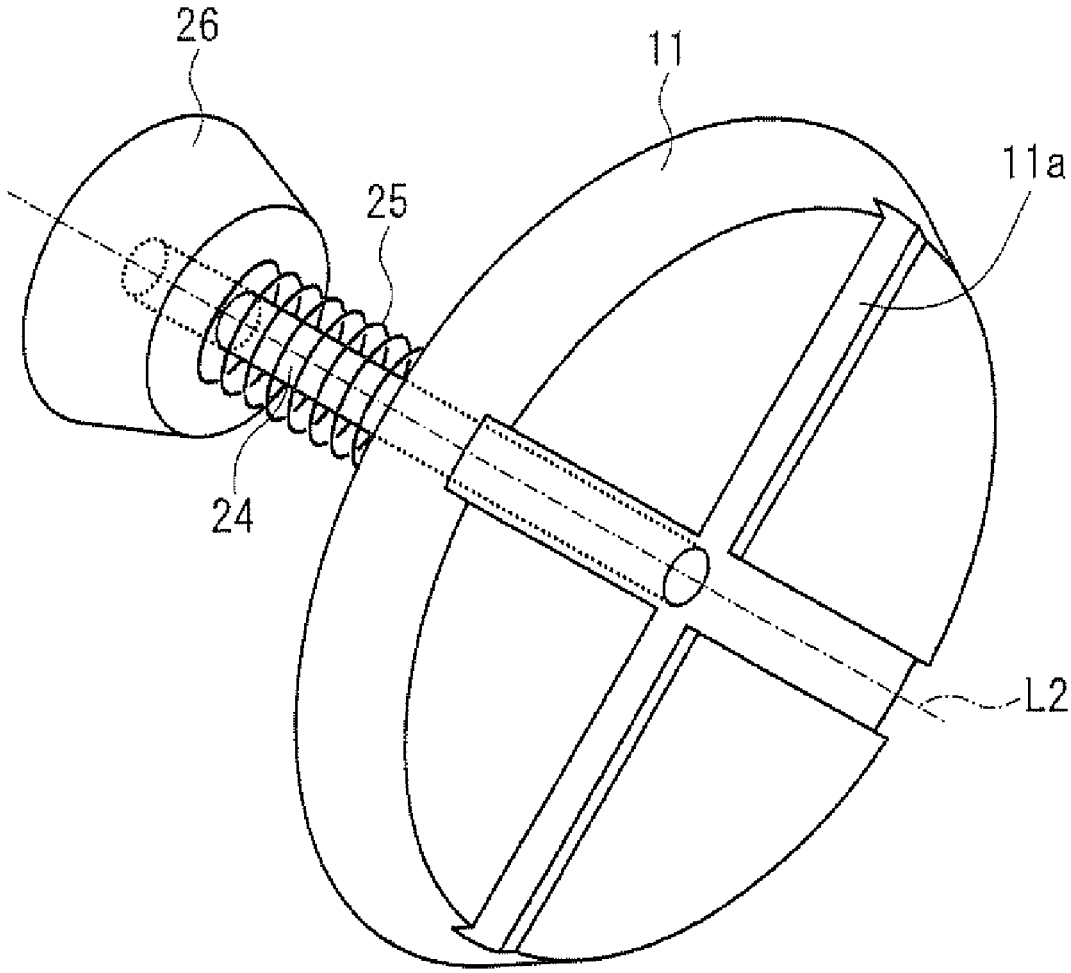
FIG. 6 is a perspective view of a drive force transmission mechanism illustrated in FIG. 1.

As shown in FIG. 3, the housing back section 17 is provided with the drive force transmission mechanism 11 in the position facing the storage space 23. FIG. 6 is a perspective view illustrating the drive force transmission mechanism 11. The drive force transmission mechanism 11 is provided for transmitting rotational drive force to the toner container 2. The drive force transmission mechanism 11 includes a rotation axis 24, a compression spring 25, and a bearing 26. The rotation axis 24 is provided to penetrate through the housing back section 17. The bearing 26 is provided on the housing back section 17 through which the rotation axis 24 penetrates. This allows the rotation axis 24 to rotate freely.

The drive force transmission mechanism 11 in the toner cartridge storage space 23 is formed in substantially a disc shape, and is fixed to the rotation axis 24 so that the drive force transmission mechanism 11 and the rotation axis 24 can integrally rotate around an axis line L2. The drive force transmission mechanism 11 has a surface, getting into contact with the toner cartridge 1, on which a fitting recessed section 11*a*, having a cross-shape, is provided so that the container-side connecting section 6 of the toner cartridge 1 can fit the fitting recessed section 11*a*.

The compression spring 25 is made of a coil spring, and is provided between the housing back section 17 and the drive force transmission mechanism 11. The compression spring 25 gives spring force such that the drive force transmission mechanism 11 moves away from the housing back section 17, without interfering the rotations of the rotation axis 24 and the drive force transmission mechanism 11.

A gear 27 is fixed at one end of the rotation axis 24, the one end being on a side opposite to the drive force transmission mechanism 11. The gear 27 receives drive force for rotating the toner container 2, the drive force being transmitted from a drive source (not illustrated) of the image forming apparatus.

The image forming apparatus includes a movement prevention mechanism 9 as a mechanism for surely maintaining a state where the toner cartridge supporting member 7 and the toner cartridge 1 are contained in the storage space 23. The movement prevention mechanism 9 includes (i) a hook member (a first member or a second member) 28 provided on the toner cartridge supporting member 7 and (ii) a locking member (the second member or the first member) 19 provided on the housing front section 16. The hook member 28 and the locking member 19 are arranged so that the hook member 28 is locked by the locking member 19, in a state where the toner cartridge supporting member 7 is completely contained in the storage space 23 of the image forming apparatus. The arrangement, in which the hook member 28 and the locking member 19 are provided, is not limited to the one described above. The hook member 28 may be provided on the housing front section 16, and the locking member 19 may be provided on the toner cartridge supporting member 7. Also, the image forming apparatus further includes a detection mechanism (a detection device) 10 at the position of the movement prevention mechanism 9. The detection mechanism 10 detects a state where the toner cartridge supporting member 7 is inserted into a predetermined position in the image forming apparatus. Furthermore, the detection mechanism 10 detects a state where the toner cartridge supporting member 7 is locked in the storage space 23 by the movement prevention mechanism 9, that is, a state where the movement prevention mechanism 9 prevents the toner cartridge supporting member 7 from moving from the storage space 23 toward the front of the image forming apparatus (in the draw-out direction H).

The detection mechanism 10 includes: a locking sensor 20 provided on the locking member 19; and a sensor activating section 21 provided on the hook member 28. The sensor activating section 21 is provided so that the locking sensor 20 is activated by the sensor activating section 21 in a state where the hook member 28 is locked by the locking member 19.

Figure 7:
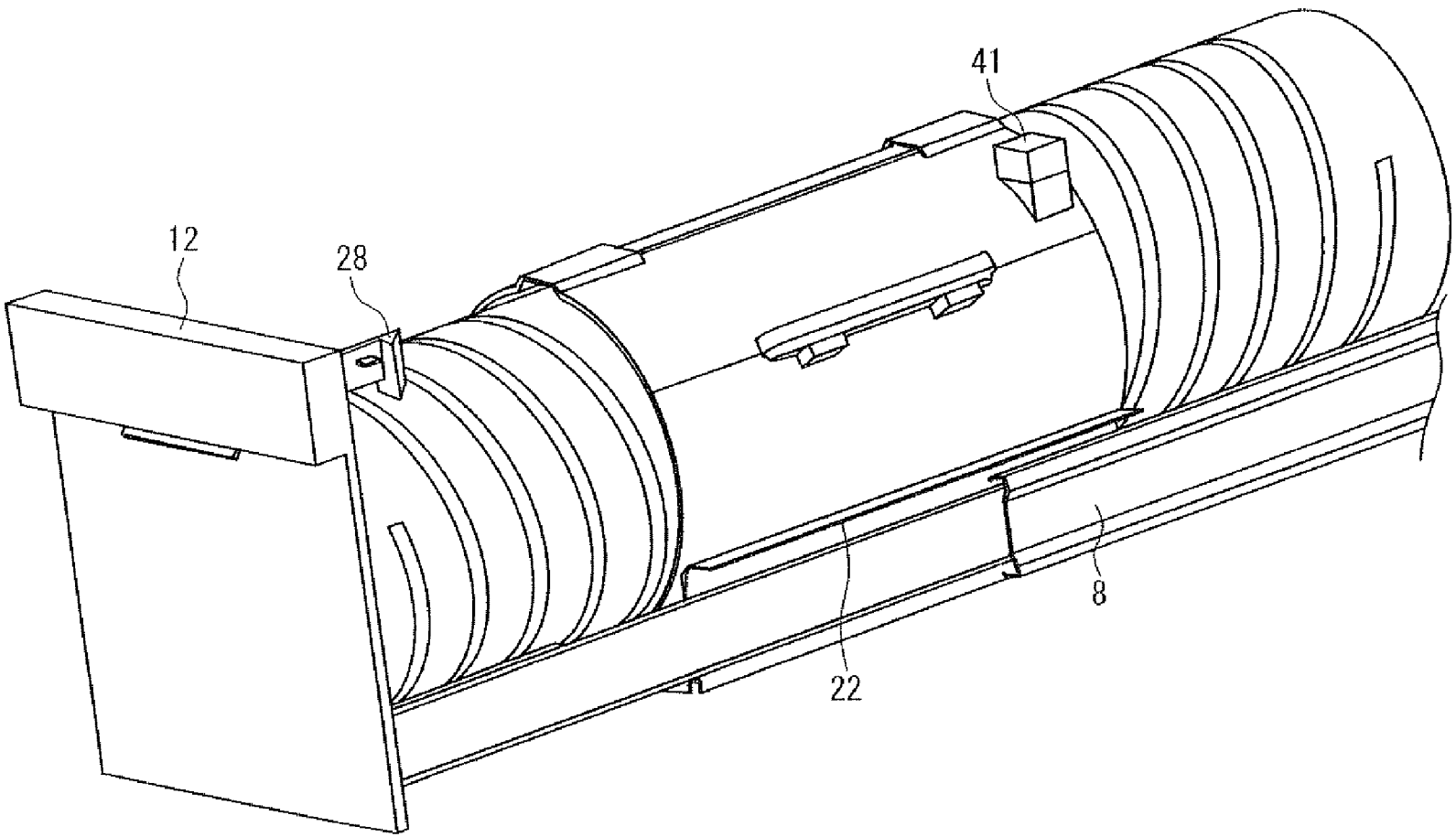
FIG. 7 is a perspective view of the toner cartridge supporting member in a state where the toner cartridge illustrated in FIG. 1 is attached to the toner cartridge supporting member.

FIG. 7 is a perspective view illustrating the toner cartridge supporting member 7 in a state where the toner cartridge 1 is attached to the toner cartridge supporting member 7. As shown in FIG. 7, the toner cartridge supporting member 7 is supported by the guide members 8, and the hook member 28 is provided on the front wall section 12 of the toner cartridge supporting member 7.

Figure 9:
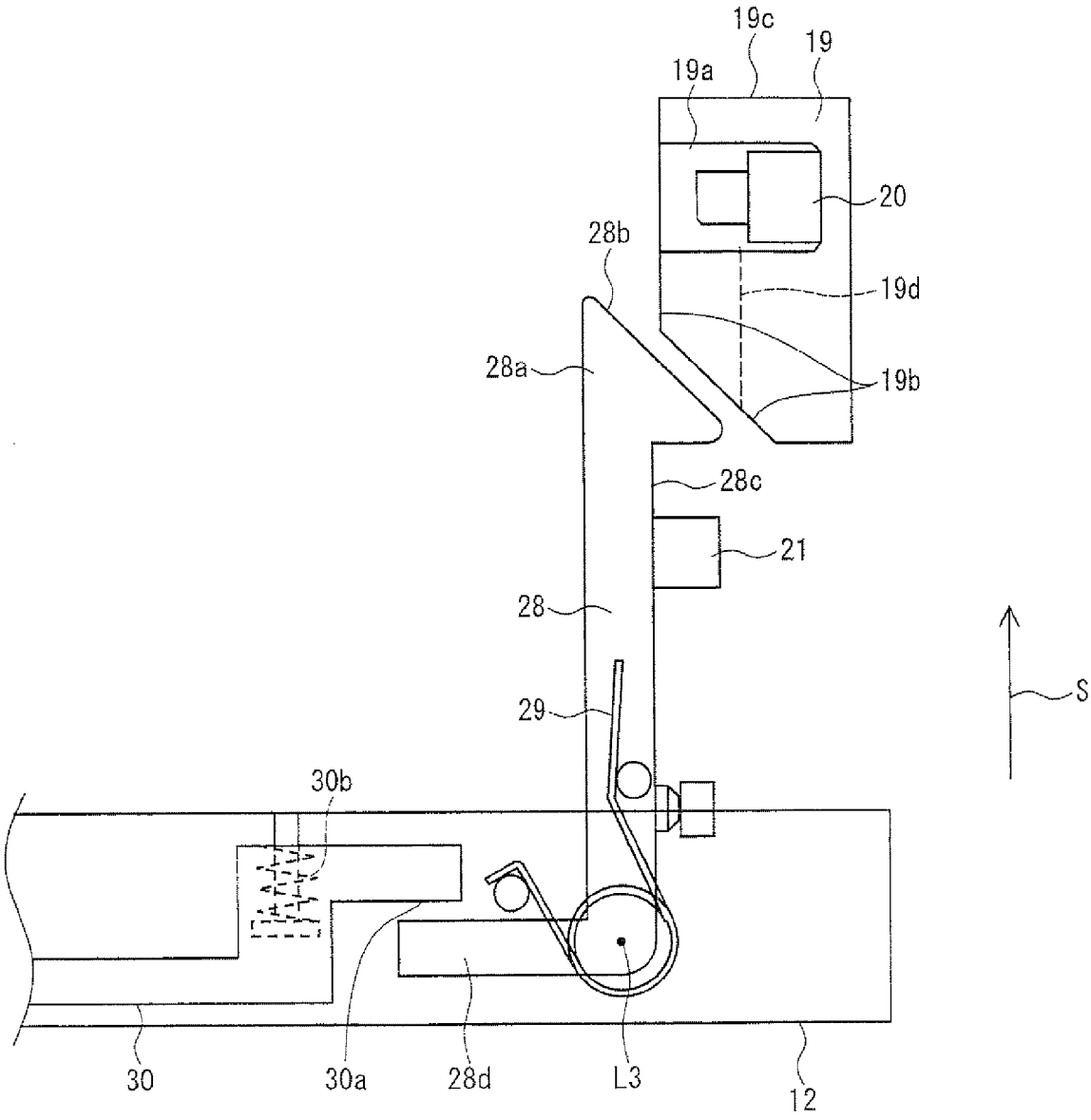
FIG. 9 is an enlarged view of a movement prevention mechanism and a detection mechanism illustrated in FIG. 1, and is a plan view illustrating a state where the toner cartridge supporting member is drawn out from the main body of the image forming apparatus and a hook member is away from a locking member.
Figure 10:
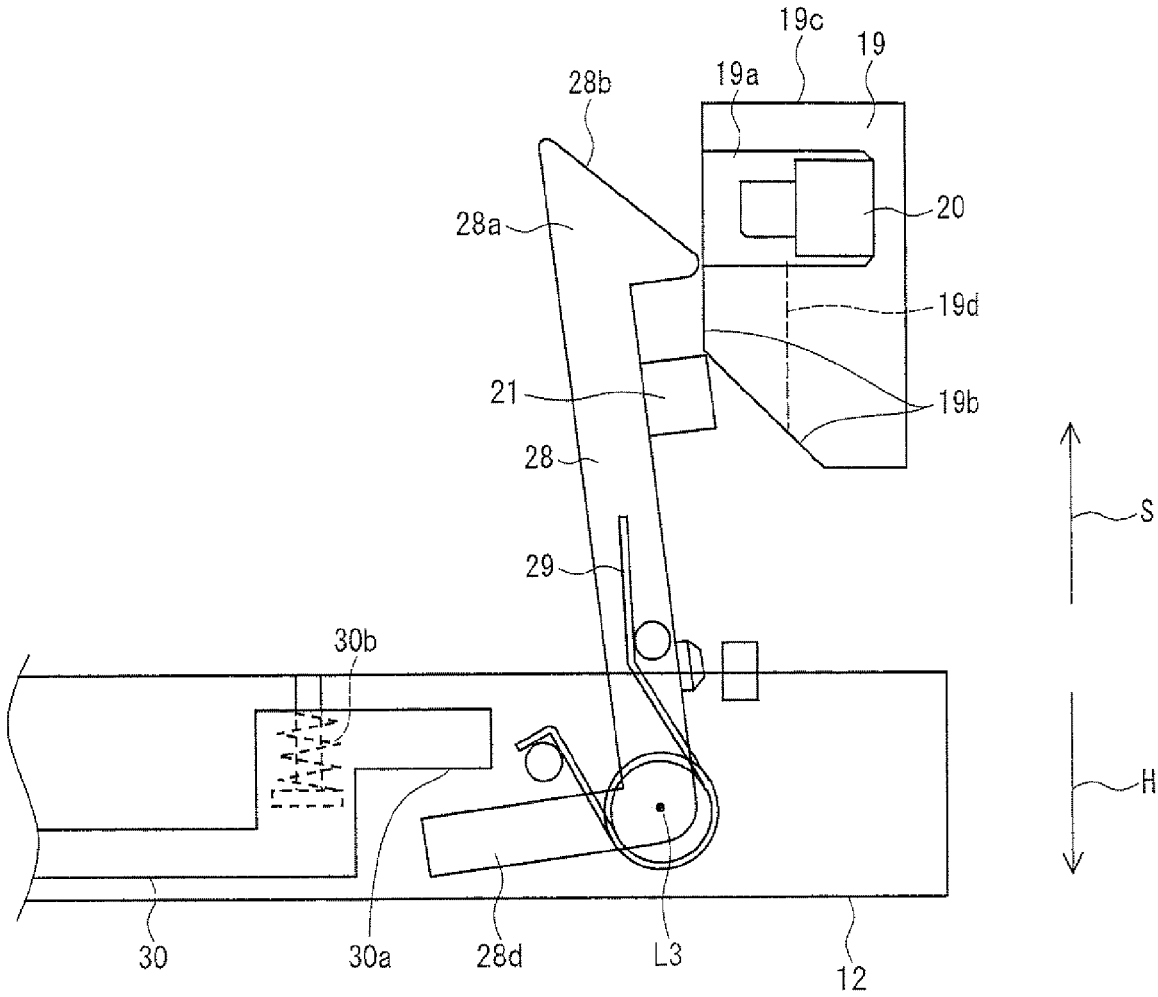
FIG. 10 is an enlarged view of the movement prevention mechanism and the detection mechanism illustrated in FIG. 1, and is a plan view illustrating a state where the toner cartridge supporting member is in the process of being inserted into the image forming apparatus and the hook member is in contact with the locking member.
Figure 11:
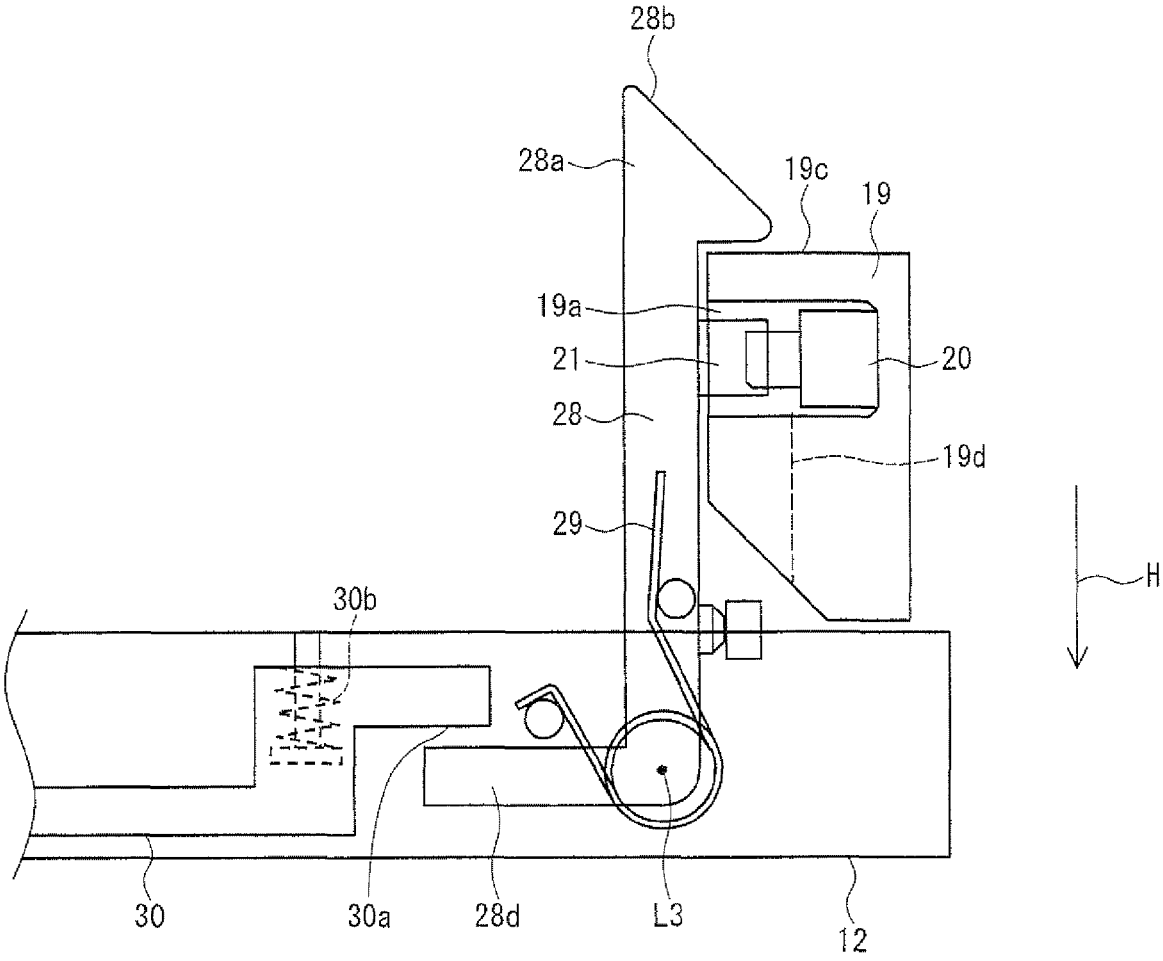
FIG. 11 is an enlarged view of the movement prevention mechanism and the detection mechanism illustrated in FIG. 1, and is a plan view illustrating a state where the toner cartridge supporting member is inserted into the image forming apparatus and the hook member is locked by the locking member.

FIG. 9 through FIG. 11 are enlarged plan views of the movement prevention mechanism 9 and the detection mechanism 10 illustrated in FIG. 1 through FIG. 3. FIG. 9 illustrates a state where the toner cartridge supporting member 7 is drawn out from the main body of the image forming apparatus and the hook member 28 is away from the locking member 19. FIG. 10 illustrates a state where the toner cartridge supporting member 7 is in the process of being inserted into the main body of the image forming apparatus and the hook member 28 is in contact with the locking member 19. FIG. 11 illustrates a state where the hook member 28 is locked by the locking member 19. When the hook member 28 is thus locked by the locking member 19, the locking sensor 20 is activated by the sensor activating section 21 in conjunction with the locking.

On this account, the sensor activating section 21 is provided, in the vicinity of a recessed corner section 28*c* (see FIG. 9), on a surface which faces a recessed section 19*a* in the locking member 19 when the hook member 28 is locked by the locking member 19. In the present embodiment, the locking sensor 20 is of a light transmission type including a light emitting section and a light receiving section. Therefore, the sensor activating section 21 is formed in a plate shape so that the sensor activating section 21 shuts out light directing from the light emitting section to the light receiving section.

As illustrated in FIG. 9, the hook member 28 is provided in substantially an L-shape, and is elastically supported by a torsion spring 29 so that a hook member top section 28*a* points a toner cartridge supporting member insertion direction S (hereinafter, merely referred to as an insertion direction S). That is, the hook member 28 is supported by the torsion spring 29 so as to get into touch with the locking member 19 in the insertion direction S. The hook member top section 28*a* includes the recessed corner section 28*c* whose corners have an angle of approximately 90 degrees so that the hook member 28 is locked by the locking member 19. The recessed corner section 28*c* has a surface in parallel with the insertion direction S and a surface perpendicular to the insertion direction S. In the hook member 28, the hook member top section 28*a* has an inclined surface 28*b*. The inclined surface 28*b* allows a reduction in shock which occurs when the hook member 28 touches the locking member 19 during the insertion of the toner cartridge supporting member 7 into the image forming apparatus.

The hook member 28 is supported by the front wall section 12 so that the hook member top section 28*a* can rotate around a rotational center L3, serving as a rotation axis (in a direction perpendicular to a sheet surface), by a rotational angle of approximately 30 degrees to the insertion direction S. FIG. 9 shows that the hook member 28 rotates in a counterclockwise direction.

One end of the torsion spring 29 is locked by the front wall section 12 and the other end of the torsion spring 29 is locked by the hook member 28 so that the hook member 28 presses against the locking member 19. The hook member 28 is displaced so that the hook member 28 is away from the locking member 19 (in FIG. 9, in a direction substantially perpendicular to the insertion direction S, that is, in a counterclockwise direction) even when the hook member 28 touches the locking member 19 during the insertion of the toner cartridge supporting member 7 into the image forming apparatus. This allows a reduction in shock which occurs during the touching.

As illustrated in FIG. 9, the locking member 19 has a locking surface 19*c* and a guide surface 19*b*. The locking surface 19*c* is a surface on which the hook member 28 is locked and which is a surface perpendicular to the insertion direction S. The guide surface 19*b* is a surface which causes the hook member 28 to be displaced in the direction substantially perpendicular to the insertion direction S when the guide surface 19*b* touches the hook member 28 during the insertion of the toner cartridge supporting member 7 into the image forming apparatus. Also, the guide surface 19*b* has the recessed section 19*a*. The locking sensor 20 is provided in the recessed section 19*a* so that the locking sensor 20 does not touch the hook member 28.

As illustrated in FIG. 9 through FIG. 11, the guide surface 19*b* of the locking member 19 has a notched section 19*d*. The notched section 19*d* is provided so as to extend from the guide surface 19*b* to the recessed section 19*a*. Also, the notched section 19*d* has a width which allows the sensor activating section 21 to get through the locking member 19 without touching the locking member 19. The notched section 19*d* causes the sensor activating section 21 not to touch the guide surface 19*b* of the locking member 19, thereby allowing to prevent wear from occurring in the guide surface 19*b* and the sensor activating section 21.

Figure 12:
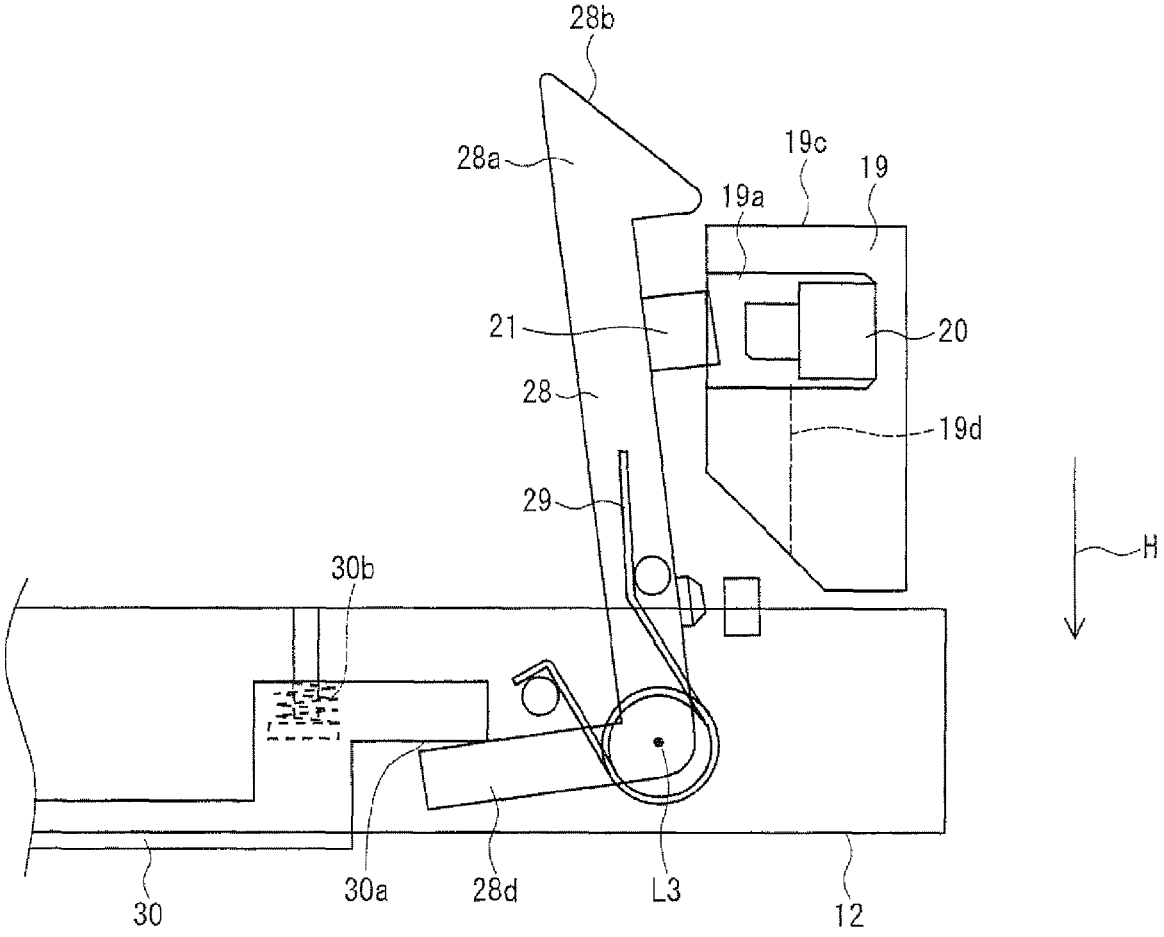
FIG. 12 is a plan view illustrating a state where the locking state of the hook member is released, from the state illustrated in FIG. 11.

FIG. 12 illustrates a state where the locking of the hook member 28 illustrated in FIG. 11 is released. The front wall section 12 includes a release lever (release operation section) 30 for releasing the locking state of the hook member 28. The release lever 30 is attached to the front wall section 12 so as to be movable in the insertion direction S or in the draw-out direction H, which is a reverse direction of the insertion direction S. The release lever 30 is moved in the insertion direction S due to extension of a spring 30*b*.

FIG. 12 shows that the release lever 30 is manually operated and is moved in the draw-out direction H. This operation causes an end 30*a* of the release lever 30 to act on a release lever acting section 28*d*. As a result, the hook member 28 is displaced (rotated) so that the hook member 28 is away from the locking member 19. This allows the hook member 28 to be away from the locking member 19.

With the arrangement, it is possible to release the locking state of the hook member 28 simply by moving the release lever 30. This improves the workability in the operation of drawing out a toner cartridge supporting member 7. Further, a single action of pulling the release lever 30 makes it possible to (i) release a locking state of the hook member 28 and (ii) draw out the toner cartridge supporting member 7. This improves the workability in the operation of drawing out a toner cartridge supporting member 7 and exchanging a toner cartridge 1 with another.

Figure 13:
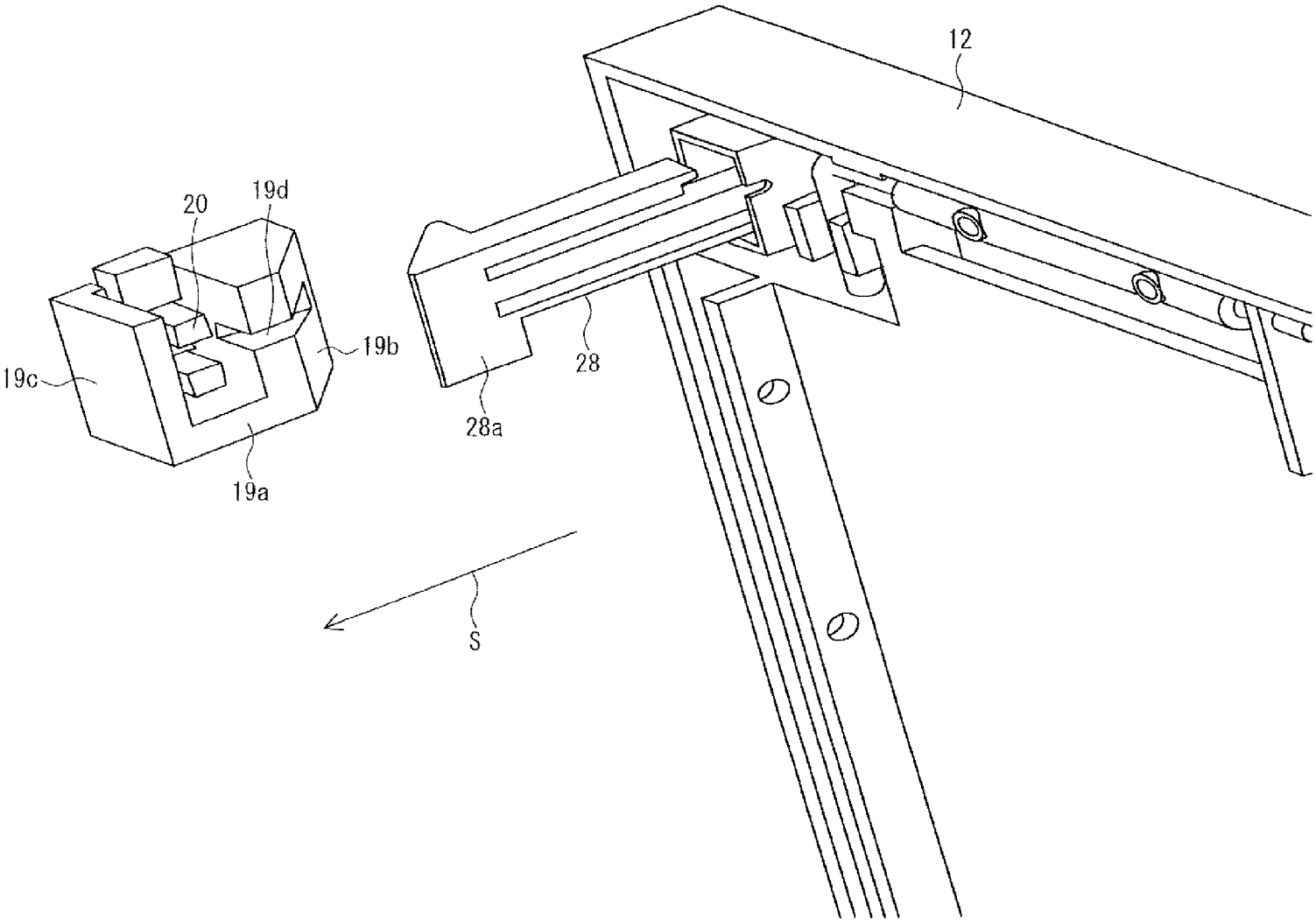
FIG. 13 is a perspective view illustrating the movement prevention mechanism and the detection mechanism illustrated in FIG. 11.

FIG. 13 is a perspective view illustrating the movement prevention mechanism 9 and the detection mechanism 10 illustrated in FIG. 9. As illustrated in FIG. 13, the locking sensor 20 of the detection mechanism 10 is of a light transmission type in which a projection including a light emitting section 75 is provided so as to face a projection including a light receiving section 76. The locking sensor 20 is provided in the recessed section 19*a* of the locking member 19. When the sensor activating section 21 shuts out a light path extending from the light emitting section 75 to the light receiving section 76, the locking sensor 20 detects the following two states: (i) a state where the hook member 28 is locked by the locking member 19 and (ii) a state where the locking state is released.

In the image forming apparatus of the present embodiment, as illustrated in FIG. 1 through FIG. 3, an information storage device 41 is provided at a predetermined position on the outer periphery of the supporting member 3 of the toner cartridge 1. A connector 42 is provided inside the image forming apparatus so as to be connected to the information storage device 41. The connector 42 is electrically connected to the information storage device 41 when (i) the toner cartridge 1 is attached to the toner cartridge supporting member 7 and (ii) the toner cartridge supporting member 7 is contained in the storage space 23.

The connector 42 is attached to a connector attaching member 31, and is movable in the insertion direction S or in the draw-out direction H. The connector attaching member 31 is provided between the housing front section 16 and the housing back section 17. The connector attaching member 31 has, for example, a plate shape.

Specifically, the connector 42 has a through-hole, and the connector attaching member 31 includes a guide bar 32. The guide bar 32 is inserted into the through-hole of the connector 42. With this arrangement, the connector 42 is guided by the guide bar 32 so as to move in the insertion direction S or in the draw-out direction H. The guide bar 32 includes a spring 33, causing the connector 42 to be pressed in the draw-out direction H, which is provided downstream of the connector 42 in the insertion direction S.

Figure 14:
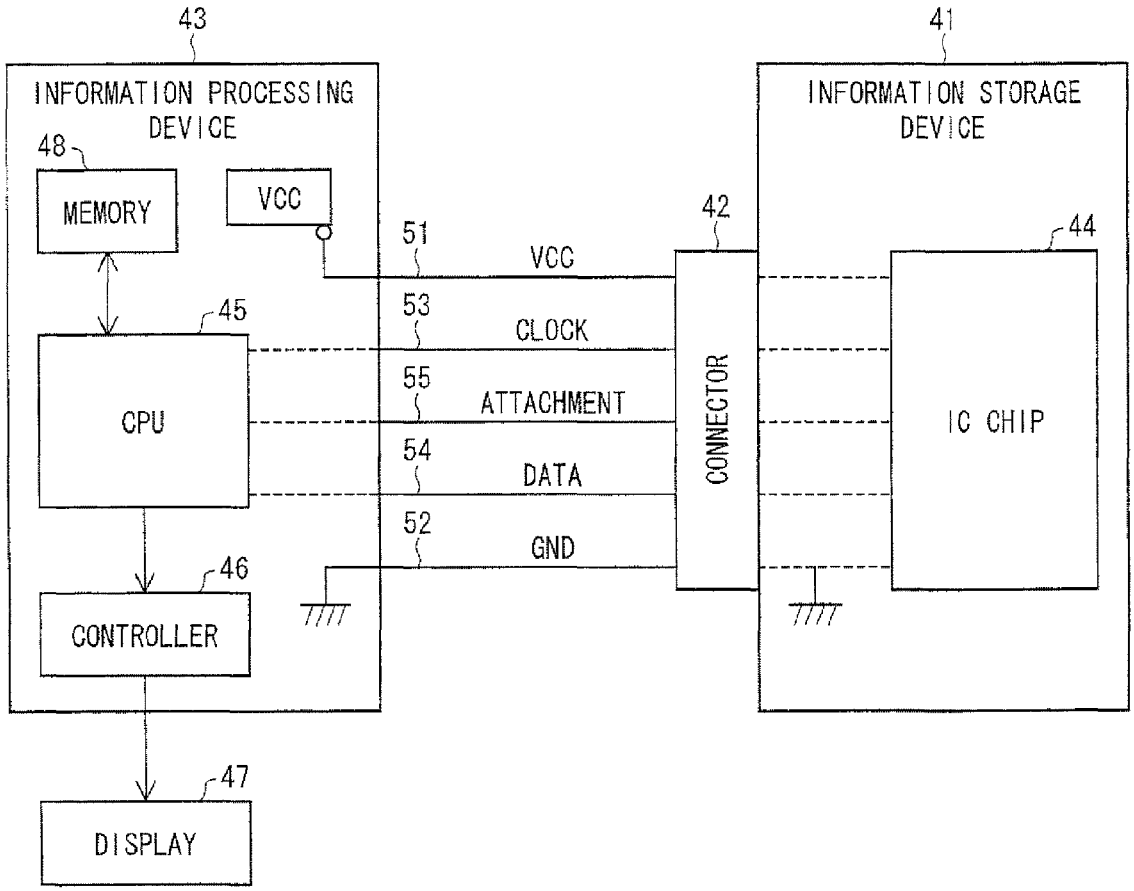
FIG. 14 is a schematic circuit diagram illustrating a state where an information processing device is connected to an information storage device each of which is included in the image forming apparatus of the present embodiment.

As illustrated in FIG. 14, the connector 42 is connected to an information processing device 43 in the image forming apparatus. FIG. 14 is a circuit diagram illustrating a state where (i) the information storage device 41 is connected to the connector 42 and (ii) the information storage device 41 is connected to the information processing device 43, via the connector 42.

As illustrated in FIG. 14, the information storage device 41 includes an IC chip 44 in which information, inherent in the toner cartridge 1, such as information for identifying the type of toner contained in the toner cartridge 1 and the remaining amount of toner is stored.

The information processing device 43 includes a CPU (a toner amount detection device) 45, a controller 46, and a memory 48. The CPU 45 is connected to the controller 46 and the memory 48, and the controller 46 is connected to a display (a display device) 47 in the image forming apparatus. The CPU 45 carries out processes with respect to various kinds of information. The controller 46 controls, in accordance with a command from the CPU 45, display operation of the display 47. The display 47 is, for example, a display section included in an operation panel of the image forming apparatus. The memory 48 functions as an operation area of the CPU 45, and stores various kinds of information.

The connector 42 is connected to a power source line 51, a ground line 52, a clock line 53, a data line (a communication state judging device) 54, and an attachment line (an electrical connection judging device) 55. The power source line 51 is supplied with power source via the information processing device 43. The ground line 52 is connected to a ground via the information processing device 43. The clock line 53, the data line 54, and the attachment line 55 are connected to the CPU 45.

Therefore, while the connector 42 is connected to the information storage device 41, (i) power source is supplied to the IC chip 44 via the power source line 51, (ii) the IC chip 44 is connected to the ground via the ground line 52, and (iii) a clock pulse is supplied to the IC chip 44 from the CPU 45, via the clock line 53. This allows data communication to be carried out between the IC chip 44 and the CPU 45, via the data line 54. The IC chip 44 receives, from the CPU 45 via the attachment line 55, information for checking whether or not the IC chip 44 and the CPU 45 are electrically connected to each other.

An arrangement for electrically connecting the information storage device 41 to the information processing device 43 is not limited to the arrangement in which the connector 42 connected to the information processing device 43 is directly connected to the information storage device 41. Examples of the arrangement encompass an arrangement in which the toner cartridge 1 includes another connector connected to the information storage device 41 and such another connector is connected to the connector 42 of the information processing device 43.

Figure 15:
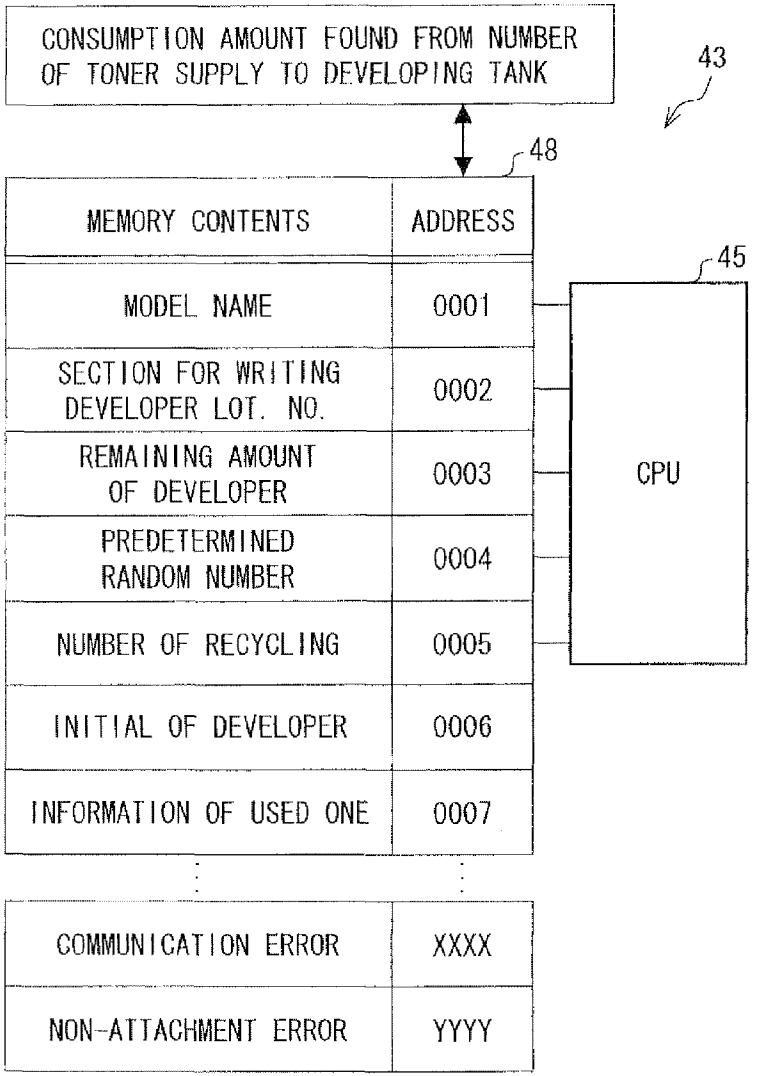
FIG. 15 (*a*) is an explanatory diagram illustrating memory contents of a memory in the information processing device illustrated in FIG. 14.
Figure 15:
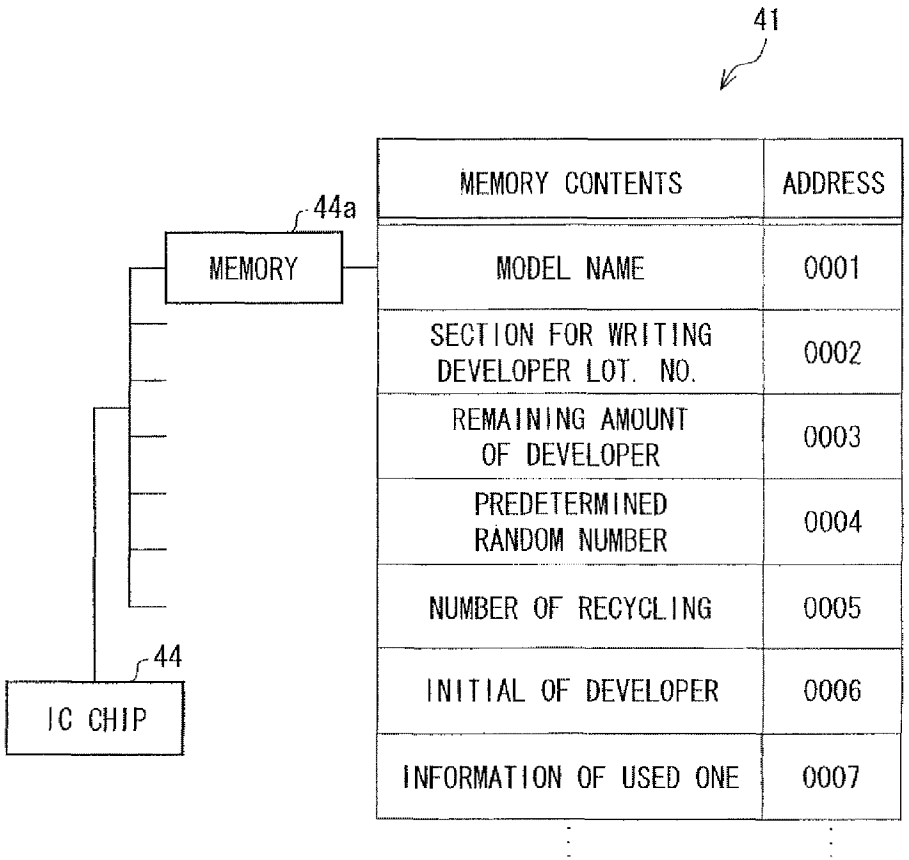

FIG. 15 (*a*) is an explanatory diagram illustrating memory contents of the memory 48 in the information processing device 43 illustrated in FIG. 14. FIG. 15 (*b*) is an explanatory diagram illustrating memory contents of a memory 44*a* in the IC chip 44 of the information storage device 41 illustrated in FIG. 14.

As illustrated in FIG. 15 (*b*), the memory 44*a* in the IC chip 44 stores various kinds of information regarding the toner cartridge 1. Specifically, address "0001" in the memory 44*a* stores model names and/or model numbers of digital copying machines in which the toner cartridge 1 is available; address "0002" in the memory 44*a* stores a lot number of the toner contained in the toner cartridge 1; address "0003" in the memory 44*a* stores the toner storage amount in the toner cartridge 1; address "0004" in the memory 44*a* stores a random number generated by the CPU 45 for the purpose of judging whether or not the toner cartridge 1 is identical to the one which has been attached before; address "0005" in the memory 44*a* stores the number of recycling of a container of the toner cartridge 1; address "0006" in the memory 44*a* stores information indicative of whether or not the toner cartridge 1 is in an initial use state; and address "0007" in the memory 44*a* stores information indicative of whether or not the toner cartridge 1 is a used one.

As illustrated in FIG. 15 (*a*), the memory 48 of the information processing device 43 stores (i) information read out by the CPU 45 from the IC chip 44 in the information storage device 41 and (ii) information regarding the image forming apparatus. Therefore, the CPU 45 can judge a state of the toner cartridge 1 in accordance with the information stored in the memory 48. Specifically, address "0001" in the memory 48 stores model names and/or model numbers of image forming apparatuses; address "0002" in the memory 48 stores a lot number of the toner contained in the toner cartridge 1, the lot number being read out from the IC chip 44; address "0003" in the memory 48 stores the toner storage amount which is read out from the IC chip 44; address "0004" in the memory 48 stores a random number generated by the CPU 45 for the purpose of judging whether or not the toner cartridge 1 is identical to the one which has been attached before; address "0005" in the memory 48 stores the number of recycling of a container of the toner cartridge 1, the number of recycling being read out from the IC chip 44; address "0006" in the memory 48 stores information indicative of the judging result of whether or not the toner cartridge 1 is in an initial use state; and address "0007" in the memory 48 stores information indicative of the judging result of whether or not the toner cartridge 1 is a used one. Address "XXXX" in the memory 48 stores information regarding a communication error, and address "YYYY" in memory 48 stores information regarding a non-attachment error. The information regarding the communication error and the information regarding the non-attachment error are judged based on the process described later.

Figure 16:
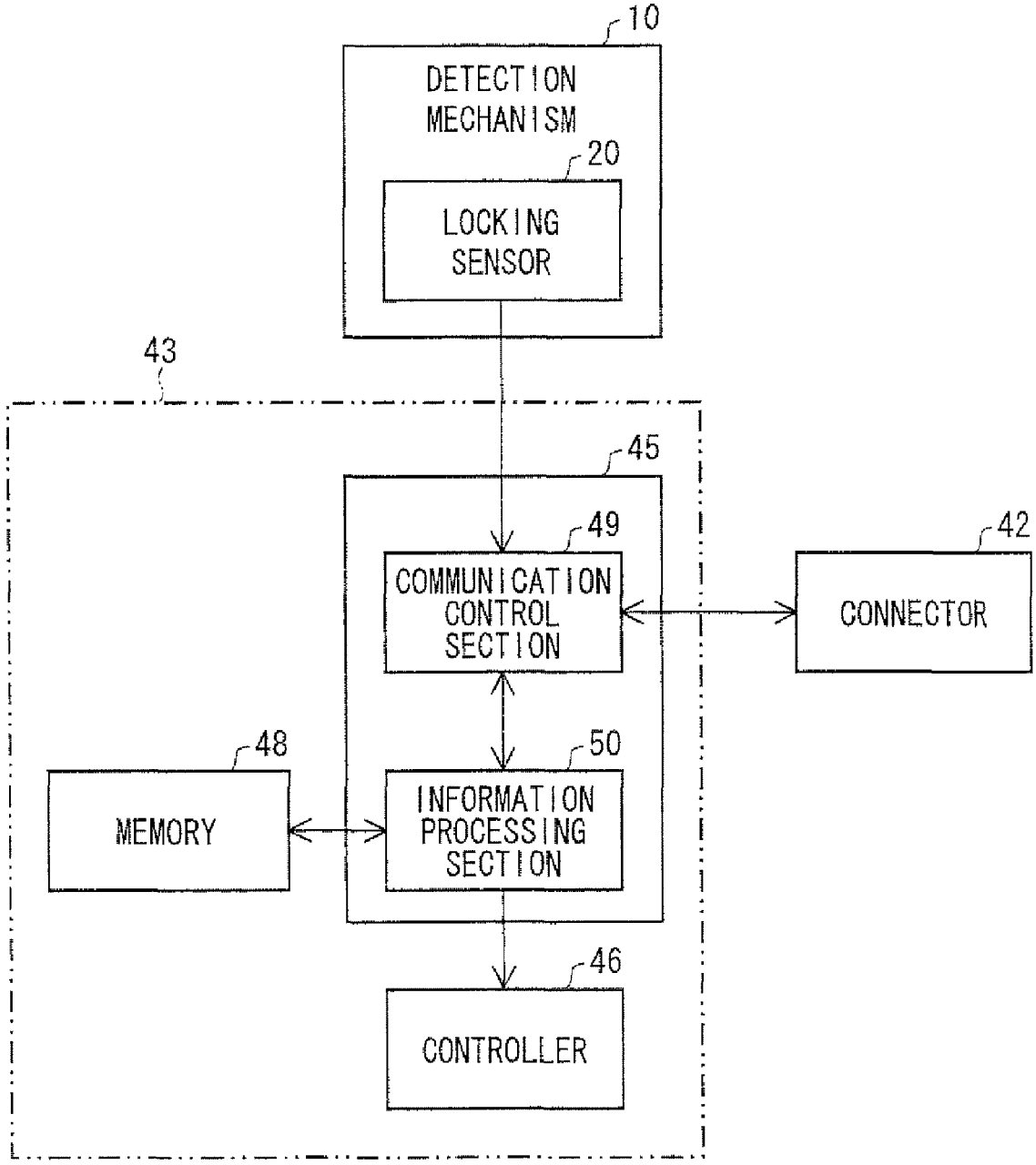
FIG. 16 is a block diagram illustrating a functional arrangement of a CPU in the information processing device illustrated in FIG. 14.

FIG. 16 is a block diagram illustrating a functional arrangement of the CPU 45 in the information processing device 43. As illustrated in FIG. 16, the CPU 45 includes a communication control section 49 and an information processing section 50. The communication control section 49 controls a communication carried out via the connector 42 between the information processing device 43 and the information storage device 41, in accordance with a detection signal supplied from the detection mechanism 10. That is, the communication control section 49 maintains the communication when the detection mechanism 10 detects a state (movement prevention state) where the movement prevention mechanism 9 prevents the toner cartridge supporting member 7 from moving from the storage space 23 in the draw-out direction H. On the other hand, the communication control section 49 stops the communication when the detection mechanism 10 detects a state where the movement prevention state is released. Prior to the stopping of the communication, the communication control section 49 requests the information storage device 41 to send the inherent information of the toner cartridge 1. In response to this request, the information storage device 41 reads out, from the memory 44*a*, information to be updated out of the inherent information of the toner cartridge 1, and transmits the information thus read out to the information processing device 43. This updates the inherent information of the toner cartridge 1 in the memory 48 in the information processing device 43 before the communication is stopped between the information storage device 41 and the information processing device 43.

The information processing section 50 is arranged so as to write information into the memory 48 and read out information from the memory 48. The information processing section 50 also carries out various kinds of processing including a display control carried out with respect to the display 47 via the controller 46.

Figure 17:
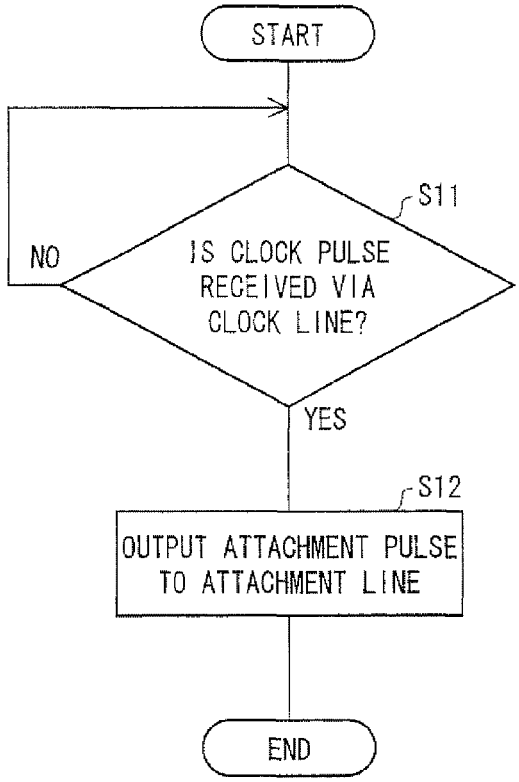
FIG. 17 (*a*) is a flow chart illustrating how the information storage device operates when the information storage device receives a clock pulse from the information processing device in the arrangement illustrated in FIG. 14.
Figure 17:
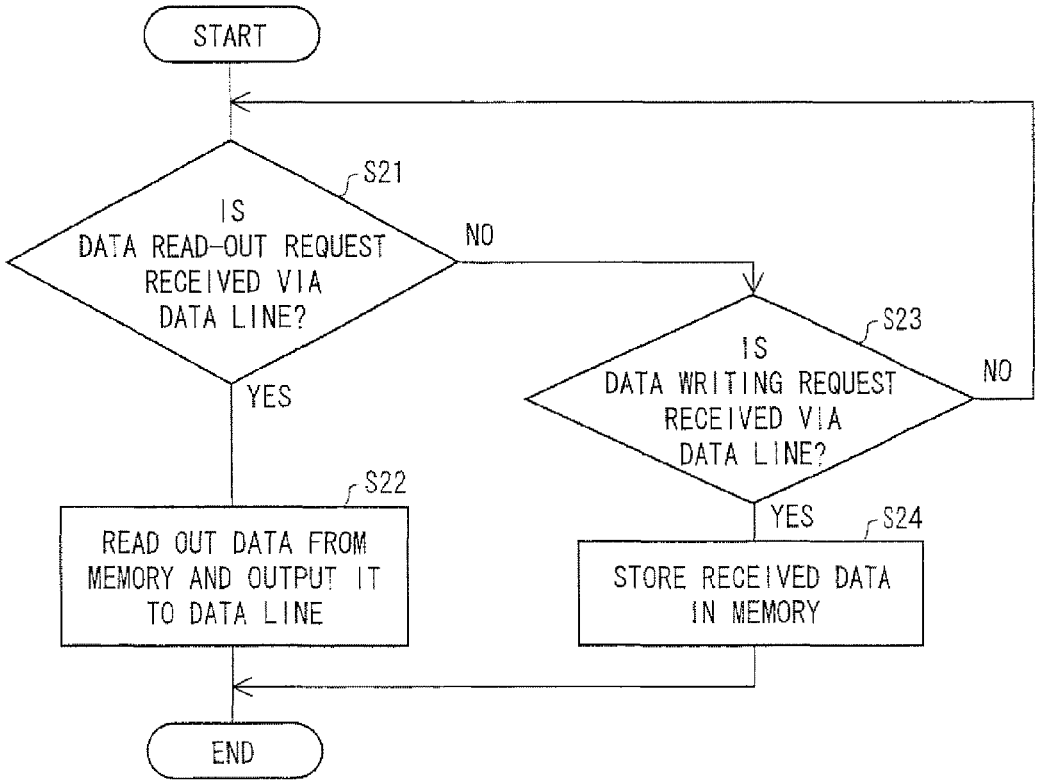

FIG. 17 (*a*) is a flow chart illustrating how the information storage device 41 operates when the information storage device 41 receives a clock pulse from the information processing device 43 in the arrangement illustrated in FIG. 14. FIG. 17 (*b*) is a flow chart illustrating how the information storage device 41 operates when the information storage device 41 receives a read-out request or a writing request from the information processing device 43 in the arrangement illustrated in FIG. 14.

With the arrangement, as shown in FIG. 17 (*a*), when the IC chip 44 in the information storage device 41 receives a clock pulse from the information processing device 43 via the clock line 53 (S11) while power source VCC is supplied to the IC chip 44 via the power source line 51, the IC chip 44 outputs an attachment pulse synchronized with the clock pulse to the attachment line 55 (S12).

As illustrated in FIG. 17 (*b*), when the IC chip 44 in the information storage device 41 receives a read-out request of data from the information processing device 43 via the data line 54 (S21), the IC chip 44 reads out data stored in the memory 44*a* and transmits the data thus read out to the information processing device 43 (S22). On the other hand, when the IC chip 44 receives a writing request from the information processing device 43 via the data line 54 (S23), the IC chip 44 stores, in a predetermined area in the memory 44*a*, data that the IC chip 44 received together with the writing request (S24).

Figure 18:
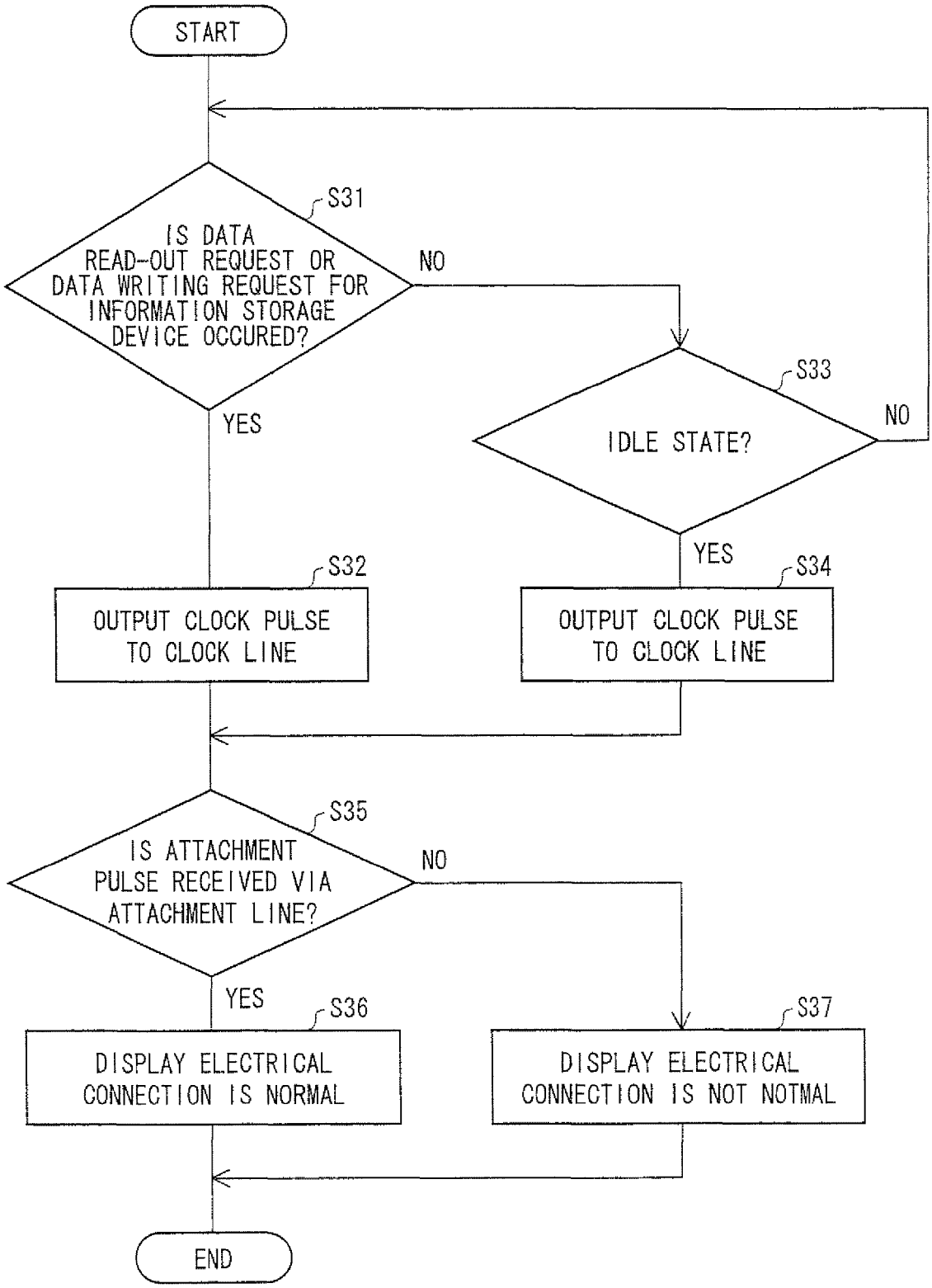
FIG. 18 is a flow chart illustrating how the information processing device operates when an electrical connection is checked between the information processing device and the information storage device in the arrangement illustrated in FIG. 14.
Figure 19:
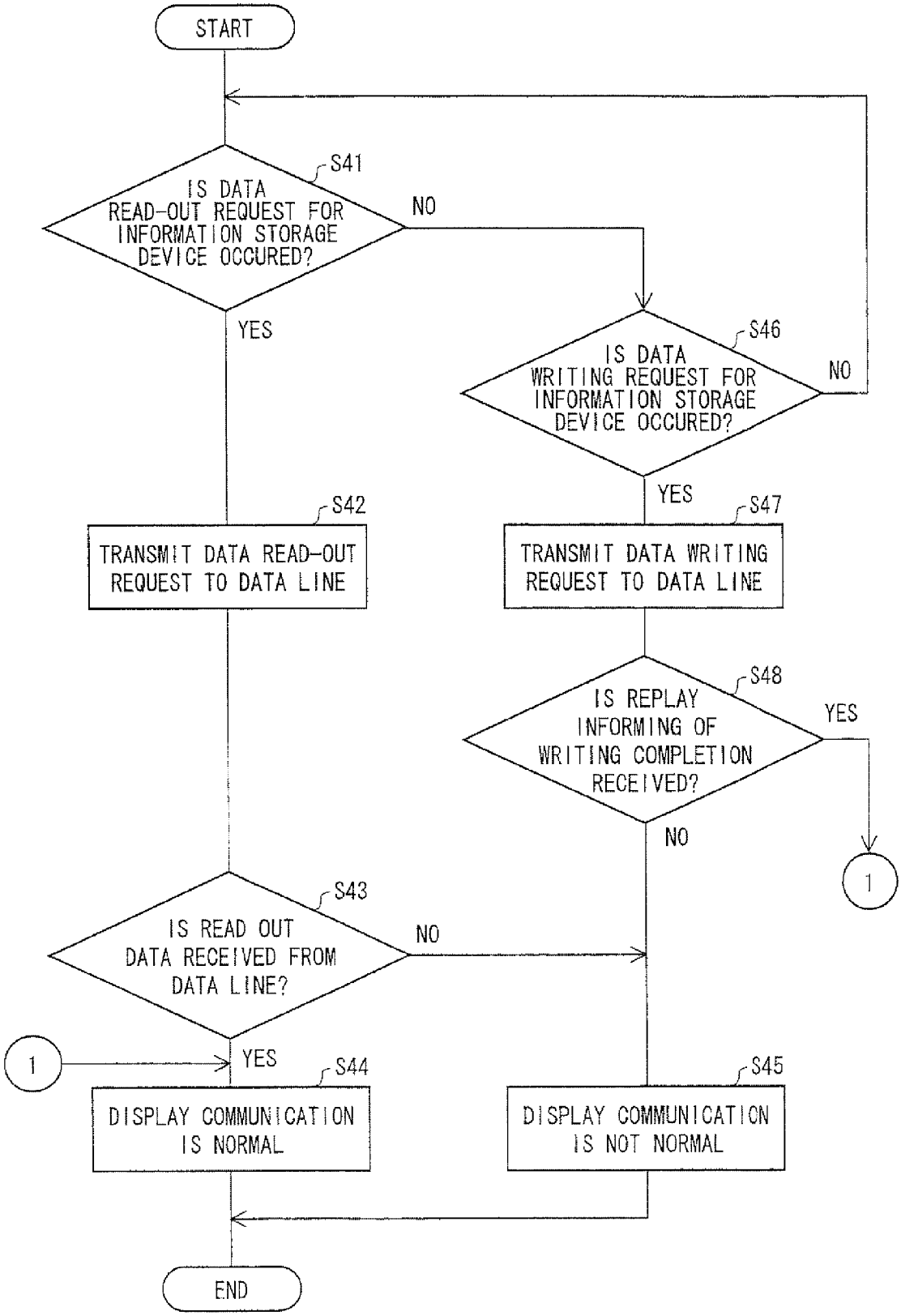
FIG. 19 is a flow chart illustrating how the information processing device operates when a read-out request or a writing request occurs with respect to the information storage device in the arrangement illustrated in FIG. 14.

FIG. 18 is a flow chart illustrating how the information processing device 43 operates when an electrical connection is checked between the information processing device 43 and the information storage device 41 in the arrangement illustrated in FIG. 14. FIG. 19 is a flow chart illustrating how the information processing device 43 operates when a read-out request or a writing request occurs with respect to the information storage device 41 in the arrangement illustrated in FIG. 14.

As illustrated in FIG. 18, when a read-out request or a writing request of data occurs with respect to the information storage device 41 (S31) while the toner cartridge 1 is attached to a predetermined position inside the image forming apparatus, the information processing device 43 transmits a clock pulse to the information storage device 41 via the clock line 53 (S32).

In an idle state where a read-out request or a writing request of data does not occur (S33), the information processing device 43 supplies a clock pulse, at a predetermined timing, to the IC chip 44 via the clock line 53 (S34). The predetermined timing refers to, for example, a timing at which a clock pulse is outputted for every predetermined period of time.

Next, the information processing device 43 judges whether or not the information storage device 41 has outputted an attachment pulse to the attachment line 55 in response to the clock pulse (S35). When it is judged that the attachment pulse has been outputted to the attachment line 55, the information processing device 43 judges that an electrical connection between the information processing device 43 and the information storage device 41 is normal. Then, the display 47 displays information indicating that the electrical connection between the information processing device 43 and the information storage device 41 is normal (S36). However, when no attachment pulse has been outputted to the attachment line 55, the information processing device 43 judges that the electrical connection between the information processing device 43 and the information storage device 41 is not normal. Then, the display 47 displays information indicating that the electrical connection between the information processing device 43 and the information storage device 41 is not normal (S37).

As illustrated in FIG. 19, when a read-out request of data occurs with respect to the information storage device 41 (S41) while the toner cartridge 1 is attached to a predetermined position inside the image forming apparatus, the information processing device 43 transmits the read-out request to the information storage device 41 via the data line 54 (S42).

After that, the information processing device 43 judges whether or not predetermined read-out data has been received from the information storage device 41 via the data line 54 (S43). When it is judged that the predetermined read-out data has been received from the information storage device 41, the information processing device 43 judges that a communication between the information processing device 43 and the information storage device 41 is normal. Then, the display 47 displays information indicting that the communication between the information processing device 43 and the information storage device 41 is normal (S44). However, when the predetermined read-out data has not been received from the information storage device 41, for example, within a predetermined period of time, the information processing device 43 judges that the communication between the information processing device 43 and the information storage device 41 is not normal. Then, the display 47 displays information indicating that the communication between the information processing device 43 and the information storage device 41 is not normal (S45).

When a writing request of data occurs with respect to the information storage device 41 (S46) while the toner cartridge 1 is attached to a predetermined position inside the image forming device, the information processing device 43 transmits the writing request to the information storage device 41 via the data line 54 (S47).

After that, the information processing device 43 judges whether or not a reply informing of the completion of the writing has been received from the information storage device 41 via the data line 54 (S48). When it is judged that the reply informing of the completion of the writing has been received from the information storage device 41, the information processing device 43 judges a communication between the information processing device 43 and the information storage device 41 is normal. Then, the display 47 displays information indicating that the communication between the information processing device 43 and the information storage device 41 is normal (S44). However, when no reply informing of the completion of the writing has been received from the information storage device 41, for example, within a predetermined period of time, the information processing device 43 judges that a communication between the information processing device 43 and the information storage device 41 is not normal. Then, the display 47 displays information indicating that the communication between the information processing device 43 and the information storage device 41 is not normal (S45).

Note that a read-out request and a writing request are outputted from the CPU 45 while image forming operation (printing operation) is carried out, as well as immediately after the toner cartridge 1 is exchanged. The memory contents in the information storage device 41 are read out during the image forming operation because process conditions need to be changed in accordance with the information such as a lot number of toner contained in the toner cartridge 1. Information is written into the information storage device 41 during the image forming operation because the remaining amount of toner should be rewritten in the toner cartridge 1 in accordance with the supplied amount of toner. The supplied amount of toner in this case is found based on the information such as the number of rotations of the toner cartridge 1 and image information (dot count).

Figure 20:
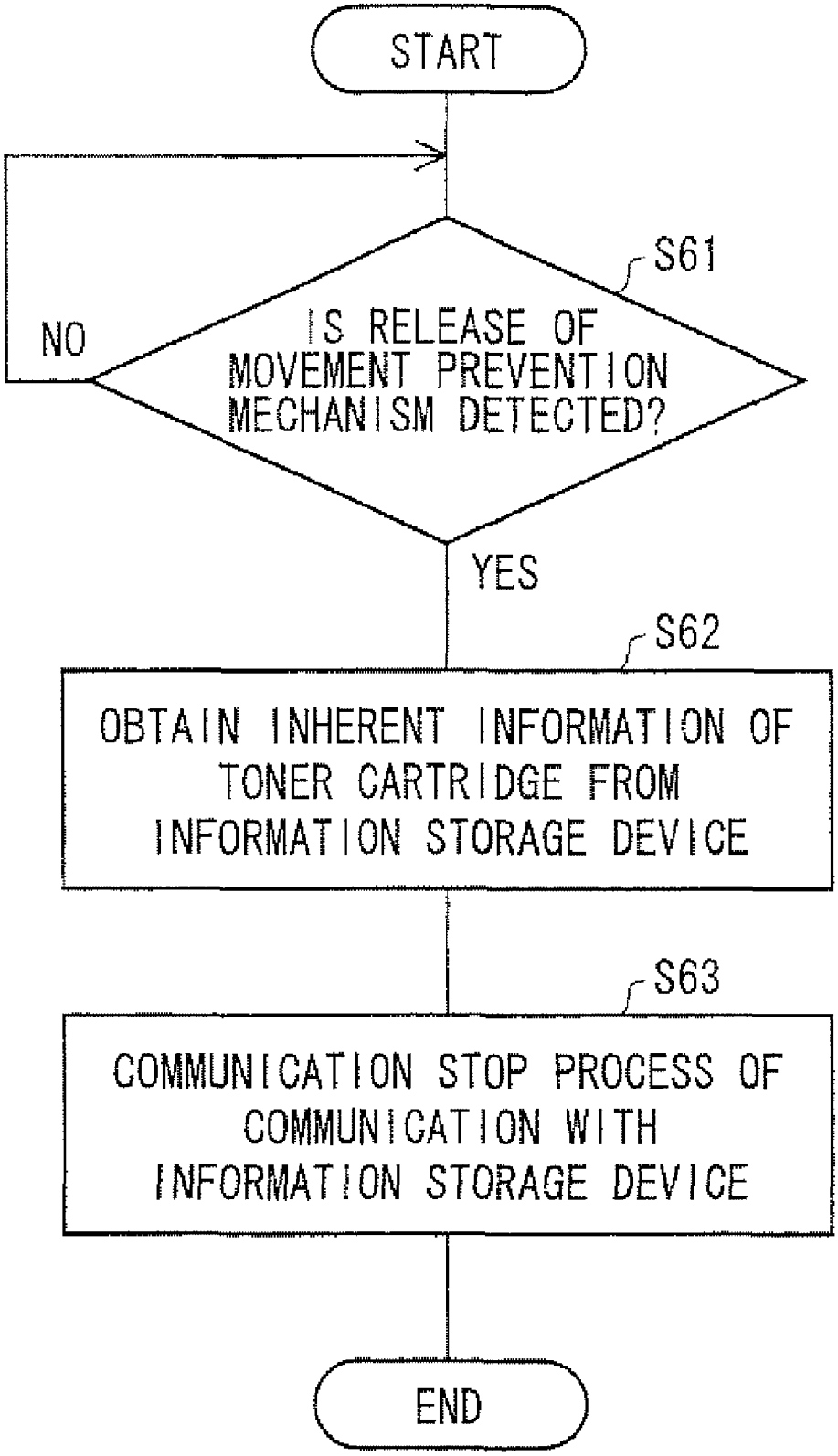
FIG. 20 is a flow chart illustrating how the information processing device stops the communication between the information processing device and the information storage device in the arrangement illustrated in FIG. 14.

FIG. 20 is a flow chart illustrating how the communication is stopped between the information storage device 41 and the information processing device 43.

FIG. 1 illustrates a state where the toner cartridge supporting member 7 is contained in a predetermined position inside the image forming apparatus. FIG. 2 illustrates a state where the toner cartridge supporting member 7 is in the process of being drawn out to the outside of the image forming apparatus completely, starting from the state illustrated in FIG. 1. In the state illustrated in FIG. 2, as well as in the state illustrated in FIG. 1, it is maintained that the information storage device 41 and the connector 42 (i.e., the information processing device 43) are electrically connected to each other. This is because that the connector 42 moves in the draw-out direction H together with the information storage device 41 when the toner cartridge supporting member 7 moves in the draw-out direction H.

In the state illustrated in FIG. 2, the connector 42 reaches an end of the guide bar 32, the end being downstream in the draw-out direction H. Therefore, when the toner cartridge supporting member 7 is further drawn out from this state, the connector 42 is no longer fitted to the information storage device 41. This causes the electrical connection between the two to be released.

Moving the toner cartridge supporting member 7 from the state illustrated in FIG. 1 to the state illustrated in FIG. 2 releases a movement prevention state in which the movement prevention mechanism 9 prevents the toner cartridge supporting member 7 from moving. This state is detected by the detection mechanism 10. This detection result is supplied to the communication control section 49 in the information processing device 43. When the communication control section 49 receives the detection result (S61), the communication control section 49 carries out a communication stop process causing the communication to be stopped between the information processing device 43 and the information storage device 41 (S63). While the communication stop process is carried out, it is maintained that the connector 42 and the information processing device 43 are electrically connected to each other. Therefore, an error does not occur in the communication between the information storage device 41 and the information processing device 43 before the communication stop process for stopping the communication is completed.

That is, with the arrangement, even if the toner cartridge supporting member 7 is suddenly drawn out from the predetermined position inside the image forming apparatus, it is possible to ensure processing time (e.g., less than 0.1 seconds) required for carrying out the communication stop process for stopping the communication between the information storage device 41 and the information processing device 43.

Prior to the stopping of the communication, the communication control section 49 carries out a read-out request of inherent information of the toner cartridge 1 with respect to the information storage device 41. This inherent information is the one, which relates to the toner cartridge 1, to be updated. When the information processing device 43 obtains the inherent information from the information storage device 41, the information processing device 43 updates the inherent information stored in the memory 48 (S62). Thus, in the information processing device 43, the inherent information of the toner cartridge 1 is updated in the memory 48 before the communication is stopped between the information storage device 41 and the information processing device 43.

Therefore, even if the toner cartridge 1 is suddenly drawn out from the image forming device, the newest inherent information of the toner cartridge 1 is stored in the information storage device 41. This allows a user to remove the toner cartridge 1 and exchange it with another, regardless of how the image forming apparatus operates. When the inherent information stored in the information storage device 41 contains the remaining amount of toner in the toner cartridge 1, the newest information regarding the remaining amount of toner in the toner cartridge 1 can be obtained. This prevents a situation where the toner cartridge 1 becomes empty suddenly.

In order to obtain the information regarding the remaining amount of toner, the image forming apparatus includes a toner amount detection device. In the present embodiment, the toner amount detection device is realized by the CPU 45. The toner cartridge 1 rotates so as to supply toner to the toner hopper 13 (i.e., the developing device 67). The amount of each toner supply is fixed to a predetermined amount. The CPU 45 finds the amount of supplied toner by counting the number of toner supply made by the toner cartridge 1. Because the toner amount in the toner cartridge 1 which is not in use is a predetermined one, it is possible to find the current toner amount in the toner cartridge 1 by subtracting the supplied amount of toner from the toner amount in the toner cartridge 1 which is not in use.

FIG. 3 illustrates a state where the toner cartridge supporting member 7 is completely drawn out from the state where the toner cartridge supporting member 7 is contained in the image forming apparatus illustrated in FIG. 1. In this state, an electrical connection is released between the information storage device 41 and the connector 42 (information processing device 43), and so the toner cartridge 1 can be removed upward from the toner cartridge supporting member 7. Removal and attachment of the toner cartridge 1 can be carried out while the toner cartridge supporting member 7 is completely drawn out to this position. This allows a user to exchange the toner cartridge 1 easily even if the toner cartridge 1 is heavy.

After the toner cartridge 1 is attached to the toner cartridge supporting member 7, the toner cartridge supporting member 7 is inserted into the toner cartridge storage space 23 inside the image forming apparatus (in the insertion direction S) together with the toner cartridge 1. At this time, the toner cartridge supporting member 7 and the toner cartridge 1 move in the elongation/contraction direction of the guide member 8.

In the detection mechanism 10 of the present embodiment, the locking sensor 20 does not detect the position of the toner cartridge 1 nor the position of the toner cartridge supporting member 7, but detects the state where the hook member 28 is locked by the locking member 19. Therefore, according to this arrangement where the detection mechanism 10 detects the release operation, it is possible to ensure longer communication between the information storage device 41 and the information processing device 43 when the communication is stopped between the information storage device 41 and the information processing device 43 after the inherent information of the toner cartridge 1 is obtained from the memory 44*a* in the information storage device 41 and then is stored in the memory 48 in the information processing device 43. This makes it possible to more surely prevent a communication error from occurring when the communication between the information storage device 41 on the toner cartridge 1 side and the information processing device 43 on the image forming apparatus side is suddenly interrupted while the two is communicating with each other.

In the movement prevention mechanism 9, the sensor activating section 21 is provided on the hook member 28 so as to be detected by the locking sensor 20 only while the hook member 28 is locked by the locking member. Therefore, the detection mechanism 10 (i.e., the locking sensor 20) can detect, at an earlier stage, a state where the locking state between the hook member 28 and the locking member 19 is likely to be released.

In the detection mechanism 10, the locking sensor 20 is provided so as to be in the locking member 19 and not to touch the hook member 28. Therefore, the locking sensor 20 is less apt to be damaged even if the toner cartridge supporting member 7 is inserted and drawn out repeatedly. The hook member 28 is displaced, due to the action of the guide surface 19*b*, in a direction substantially perpendicular to the insertion direction of the toner cartridge supporting member 7 when the toner cartridge supporting member 7 is inserted into the storage space 23. On this account, the locking sensor 20 is not directly subjected to a shock which occurs when the toner cartridge supporting member 7 containing the toner cartridge 1 is inserted. This causes a damage or a malfunction not to occur easily.

The movement prevention mechanism 9 and the detection mechanism 10 can be provided in the same space. This enhances space efficiency in the image forming apparatus.

The detection mechanism 10 is arranged so as to detect a locking state of the hook member 28 (i.e., the toner cartridge supporting member 7) while the sensor activating section 21 shuts out a light path of the locking sensor 20. This eliminates the need for causing the locking sensor 20 to touch the sensor activating section 21 in the detection mechanism 10, and therefore the locking sensor 20 is not subjected to a shock. As a result, the detection mechanism 10 can stably carry out detection operation for a long term.

The technology is applicable to an apparatus, such as an electrostatic copying machine, a laser printer, or a facsimile each of which carries out a printing process with the use of toner, in which a toner cartridge that rotates and supplies toner contained inside the toner cartridge is detachably provided.

As described above, an image forming apparatus may have an arrangement where a range, in which the connector moves while the connector is fitted into the information storage device, is set to be between (i) a position where the connector is when the toner cartridge supporting member is at the insertion position and (ii) a position where the connector is before the toner cartridge supporting member reaches the draw-out position.

With this arrangement, when the toner cartridge supporting member is drawn out and reaches the draw-out position, the locking state between the information storage device and the connector is released. Therefore, the toner cartridge can be easily removed from the toner cartridge supporting member at the draw-out position of the toner cartridge supporting member, and the release operation of the fitting between the two does not need to be carried out.

The image forming apparatus may have an arrangement where the information processing device obtains the inherent information of the toner cartridge which is stored in the information storage device, before the communication stop process is carried out.

With this arrangement, the inherent information of the toner cartridge which inherent information is stored in the information storage device can be obtained even when the toner cartridge supporting member, that is, the toner cartridge is suddenly drawn out from the image forming apparatus. This allows a user to exchange a toner cartridge while the image forming apparatus is operating, by referring to the inherent information thus obtained (e.g., by referring to the inherent information thus obtained displayed on a display section on an operation panel of the image forming apparatus). This raises the operation rate of an image forming apparatus and enhances the operation efficiency in the use of an image forming apparatus.

The image forming apparatus may include a toner amount detection device which detects toner amount in the toner cartridge, and may have an arrangement where the inherent information includes information regarding the toner amount detected by the toner amount detection device.

With this arrangement, because the inherent information of the toner cartridge includes the information regarding the toner amount, the information regarding the toner amount is updated at an appropriate timing. This prevents a situation where the toner cartridge becomes empty suddenly.

The image forming apparatus may include a movement prevention mechanism that carries out (i) movement prevention operation for causing the toner cartridge supporting member to be prevented from moving in a direction pointing from the insertion position toward the draw-out position and (ii) release operation for causing the movement prevention operation to be released, and may have an arrangement where the detection device detects the release operation, when the toner cartridge supporting member moves in the direction pointing from the insertion position toward the draw-out position.

With this arrangement, the detection device detects the release operation of the movement prevention operation which is carried out by the movement prevention mechanism and which prevents the toner cartridge supporting member in the direction pointing from the insertion position toward the draw-out position, when the toner cartridge supporting member moves in the direction pointing from the insertion position toward the draw-out position. That is, when the release operation is carried out by the movement prevention mechanism, the toner cartridge supporting member can move from the insertion position toward the draw-out position. Therefore, if the information processing device carries out the communication stop process for stopping the communication between the information processing device and the information storage device at this point, the following case will be avoided more surely: The communication between the two is interrupted before the communication stop process is completed, and thereby a communication error occurs.

The image forming apparatus may have an arrangement where: the movement prevention mechanism includes a first member provided on the toner cartridge supporting member and a second member provided on the image forming apparatus, and carries out the movement prevention operation by locking operation between the first member and the second member; and the detection device detects the release operation by detecting a movement of the first member or the second member by which movement release operation of locking of the first member and the second member is followed.

With this arrangement, the detection device detects the release operation by detecting the release operation (carried out by the movement prevention mechanism) of the movement prevention operation which prevents the toner cartridge supporting member from moving in the direction pointing from the insertion position toward the draw-out position, that is, by detecting the movement of the first member or the second member by which movement release operation (carried out by the movement prevention mechanism) of locking of the first member and the second member is followed.

This makes it possible to ensure longer communication between the information storage device and the information processing device before the connector of the image forming apparatus is detached from the information storage device in the toner cartridge, after the toner cartridge supporting member moves toward the draw-out position. This prevents more surely a communication error which occurs when the communication between the information processing device and the information storage device is interrupted before the communication stop process for stopping the communication between the two is completed.

The image forming apparatus may have an arrangement where: the detection device includes a sensor activating section and a locking sensor that detects the sensor activating section; one of the first and second members is realized by a hook member, and the other is realized by a locking member by which the hook member is locked; and the sensor activating section is provided on the hook member so as to be detected by the locking sensor only while the hook member is locked by the locking member.

With this arrangement, the sensor activating section is provided on the hook member so as to be detected by the locking sensor only while the hook member is locked by the locking member. This allows the locking sensor of the detection device to detect, at an earlier stage, a state where the locking state between the hook member and the locking member is likely to be released.

The image forming apparatus may have an arrangement where: the hook member is provided so as to be capable of being displaced in a direction in which the hook member gets into touch with the locking member or in a direction in which the hook member is away from the locking member, and is pressed in a direction in which the hook member gets into touch with the locking member; the locking member includes (a) a locking surface by which the hook member is locked, (b) a guide surface which guides the hook member so that the hook member is locked by the locking surface, and (c) a recessed section; the recessed section is provided with the locking sensor; and the sensor activating section is inserted into the recessed section and is detected by the locking sensor, while the hook member is locked by the locking surface, after the hook member is guided to the guide surface, in response to a movement of the toner cartridge supporting member toward the insertion position.

With this arrangement, the hook member is locked by the locking surface, after the hook member is guided to the guide surface, in response to the movement of the toner cartridge supporting member toward the insertion position. In this locking state, the sensor activating section provided on the hook member is inserted into the recessed section provided on the locking member and thereby is detected by the locking sensor. In the arrangement where the locking sensor is provided in the recessed section of the locking member and the locking sensor detects the sensor activating section inserted into the recessed section, such a case rarely occurs that things other than the sensor activating section activate the locking sensor. This allows the locking sensor to carry out accurate detection operation. Also, the locking sensor is less apt to be directly subjected to a shock which occurs when the toner cartridge supporting member containing the toner cartridge is inserted into the image forming apparatus, and thereby a damage or a malfunction does not easily occur in the locking sensor.

The image forming apparatus may have an arrangement where: the locking sensor includes a light emitting section and a light receiving section which are provided so as to face each other; and the sensor activating section is detected by the locking sensor when the sensor activating section shuts out a light path between the light emitting section and the light receiving section.

With this arrangement, the locking sensor is less apt to be subjected to a mechanical shock. This allows the locking sensor to stably carry out detection for a long term.

The image forming apparatus may have an arrangement where the toner cartridge supporting member includes a manually operable release operation section that releases the locking state between the first member and the second member.

With this arrangement, the release operation section to be operated in an exchange of a toner cartridge is provided on the toner cartridge supporting member which is drawn out from the image forming apparatus in the exchange of the toner cartridge. This improves workability in an exchange of a toner cartridge.

The image forming apparatus may have an arrangement where the release operation section serves as a knob to be used when the toner cartridge supporting member is drawn out from the image forming apparatus.

With this arrangement, the release operation section serves as a knob of the toner cartridge supporting member. Therefore, when a toner cartridge is exchanged, a single action can carry out (i) operation for the release operation section for releasing the locking state between the first member and the second member and (ii) operation for drawing out the toner cartridge supporting member from the image forming apparatus. This further improves the workability in an exchange of a toner cartridge.

The embodiments and concrete examples of implementation discussed in the foregoing detailed explanation serve solely to illustrate the technical details, which should not be narrowly interpreted within the limits of such embodiments and concrete examples, but rather may be applied in many variations within the spirit of the technology, provided such variations do not exceed the scope of the patent claims set forth below.

What is claimed is:

1. An image forming apparatus, comprising:

a toner cartridge supporting member provided to support a toner cartridge, the toner cartridge supporting member being movable between (i) an insertion position in which a toner cartridge on the toner cartridge supporting member is in a working position and (ii) a draw-out position in which a toner cartridge can be mounted on or dismounted from the toner cartridge supporting member;

a detection device which detects a movement of the toner cartridge supporting member in a direction pointing from the insertion position toward the draw-out position;

a connector which is provided so as to be detached from or fitted to an information storage device on a toner cartridge, the connector being provided on a connector attaching member on the image forming apparatus that is movable in a moving direction of the toner cartridge supporting member; and an information processing device which is capable of communicating with an information storage device of a toner cartridge via the connector, which carries out writing and readout of inherent information stored on an information storage device of a toner cartridge, and which carries out a communication stop process for causing a communication between the information processing device and an information storage device of a toner cartridge to be stopped when the detection device detects movement of the toner cartridge supporting member, wherein the information processing device is configured to obtain the inherent information of a toner cartridge which is stored in the information storage device of a toner cartridge before the communication stop process is carried out, and wherein when a toner cartridge is mounted on the toner cartridge supporting member, and the toner cartridge supporting member is in the insertion position, the connector will move with and remain in contact with an information storage device on the toner cartridge as the toner cartridge supporting member and the toner cartridge move away from the insertion position and towards the draw-out position.

2. The image forming apparatus as set forth in claim 1, wherein the connector moves between (i) a first position where the connector is when the toner cartridge supporting member is at the insertion position and (ii) a second position where the connector is before the toner cartridge supporting member reaches the draw-out position.

3. The image forming apparatus as set forth in claim 1, further comprising a toner amount detection device which detects toner amount in the toner cartridge, wherein the inherent information includes information regarding the toner amount detected by the toner amount detection device.

4. The image forming apparatus as set forth in claim 1, further comprising a movement prevention mechanism that carries out (i) a movement prevention operation for causing the toner cartridge supporting member to be prevented from moving in a direction pointing from the insertion position toward the draw-out position and (ii) a release operation for causing the movement prevention operation to be released, wherein the detection device detects the release operation when the toner cartridge supporting member moves in the direction pointing from the insertion position toward the draw-out position.

5. The image forming apparatus as set forth in claim 4, wherein the movement prevention mechanism includes a first member provided on the toner cartridge supporting member and a second member provided on the image forming apparatus, and carries out the movement prevention operation by performing a locking operation between the first member and the second member, and the detection device detects the release operation by detecting a movement of the first member or the second member, the movement causing a release of the locking operation between the first member and the second member.

6. The image forming apparatus as set forth in claim 5, wherein the toner cartridge supporting member includes a manually operable release operation section that releases the locking state between the first member and the second member.

7. The image forming apparatus as set forth in claim 6, wherein the release operation section comprises a grasping portion that can be grasped by a user when the toner cartridge supporting member is drawn out from the image forming apparatus.

8. The image forming apparatus as set forth in claim 5, wherein the detection device includes a sensor activating section and a locking sensor that detects the presence of the sensor activating section, wherein one of the first and second members comprises a hook member, and the other comprises a locking member by which the hook member is locked, and wherein the sensor activating section is provided on the hook member so as to be detected by the locking sensor only while the hook member is locked by the locking member.

9. The image forming apparatus as set forth in claim 8, wherein the hook member moves in a first direction in which the hook member engages the locking member and in a second direction in which the hook member releases the locking member, and wherein the hook member is biased to move in the first direction in which the hook member engages the locking member, the locking member includes (a) a locking surface by which the hook member is locked, (b) a guide surface which guides the hook member so that the hook member is locked by the locking surface, and (c) a recessed section, the recessed section is provided with the locking sensor, and the sensor activating section is inserted into the recessed section and is detected by the locking sensor, while the hook member is locked by the locking surface, after the hook member is guided to the guide surface, in response to a movement of the toner cartridge supporting member toward the insertion position.

10. The image forming apparatus as set forth in claim 9, wherein the locking sensor includes a light emitting section and a light receiving section which are provided so as to face each other, and wherein the sensor activating section is detected by the locking sensor when the sensor activating section blocks a light path between the light emitting section and the light receiving section.

11. The image forming apparatus as set forth in claim 1, further comprising a toner cartridge that is configured to be mounted on the toner cartridge supporting member, the toner cartridge including an information storage device in which inherent information of the toner cartridge is stored, the information storage device being provided on the toner cartridge such that when the toner cartridge is mounted on the toner cartridge supporting member and moved into the predetermined insertion position, the connector on the image forming apparatus mates with a corresponding connector on the information storage device.

12. The image forming apparatus as set forth in claim 11, wherein the toner cartridge includes (i) a toner container section in which toner is contained and which rotates and discharges the toner from a discharge opening and (ii) a supporting member that supports and freely rotates the toner container section around an axis line.

13. The image forming apparatus as set forth in claim 12, further comprising a drive force transmission mechanism that transmits rotational drive force to the toner container section in the toner cartridge, the toner container section including, at one end in the axis line direction, a container-side connection section that allows the toner container section to connect to or release from the drive force transmission mechanism.

14. An image forming apparatus, comprising:

a toner cartridge supporting member provided to support a toner cartridge, the toner cartridge supporting member being movable between (i) an insertion position in which a toner cartridge on the toner cartridge supporting member is in a working position and (ii) a draw-out position in which a toner cartridge can be mounted on or dismounted from the toner cartridge supporting member;

a detection device which detects a movement of the toner cartridge supporting member in a direction pointing from the insertion position toward the draw-out position;

a connector which is provided so as to be detached from or fitted to an information storage device on a toner cartridge, the connector being provided on a connector attaching member on the image forming apparatus that is movable in a moving direction of the toner cartridge supporting member;

an information processing device which is capable of communicating with an information storage device of a toner cartridge via the connector, which carries out writing and readout of inherent information stored on an information storage device of a toner cartridge, and which carries out a communication stop process for causing a communication between the information processing device and an information storage device of a toner cartridge to be stopped when the detection device detects movement of the toner cartridge supporting member, wherein the information processing device is configured to obtain the inherent information of a toner cartridge which is stored in the information storage device of a toner cartridge before the communication stop process is carried out;

a movement prevention mechanism that carries out (i) a movement prevention operation for causing the toner cartridge supporting member to be prevented from moving in a direction pointing from the insertion position toward the draw-out position and (ii) a release operation for causing the movement prevention operation to be released, wherein the movement prevention mechanism includes a first member provided on the toner cartridge supporting member and a second member provided on the image forming apparatus, and carries out the movement prevention operation by performing a locking operation between the first member and the second member, wherein the detection device detects the release operation when the toner cartridge supporting member moves in the direction pointing from the insertion position toward the draw-out position, and wherein the detection device includes a sensor activating section and a locking sensor that detects the presence of the sensor activating section, wherein one of the first and second members comprises a hook member, and the other comprises a locking member by which the hook member is locked, and wherein the sensor activating section is provided on the hook member so as to be detected by the locking sensor only while the hook member is locked by the locking member.

* * * * *